US007460796B2

(12) United States Patent
Itagaki et al.

(10) Patent No.: US 7,460,796 B2
(45) Date of Patent: Dec. 2, 2008

(54) METHOD FOR MEASURING AMOUNT OF TONER, METHOD FOR IMAGE FORMATION, TONER AMOUNT MEASURING APPARATUS, AND IMAGE FORMING APPARATUS

(75) Inventors: Tomohisa Itagaki, Abiko (JP); Ryo Hanashi, Moriya (JP)

(73) Assignee: Canon Kabushiki Kaisha (JP)

( * ) Notice: Subject to any disclaimer, the term of this patent is extended or adjusted under 35 U.S.C. 154(b) by 108 days.

(21) Appl. No.: 11/734,860

(22) Filed: Apr. 13, 2007

(65) Prior Publication Data

US 2007/0242966 A1 Oct. 18, 2007

(30) Foreign Application Priority Data

Apr. 13, 2006 (JP) ..... 2006-111047

(51) Int. Cl.
*G03G 15/00* (2006.01)

(52) U.S. Cl. ..... 399/15; 399/45; 399/49; 399/72; 399/73; 399/74

(58) Field of Classification Search ..... 399/15, 399/45, 49, 60, 72–74
See application file for complete search history.

(56) References Cited

U.S. PATENT DOCUMENTS

2005/0088710 A1* 4/2005 Nakayama ..... 358/518
2005/0214006 A1* 9/2005 Bessho ..... 399/49
2005/0260004 A1* 11/2005 Maebashi et al. ..... 399/15
2005/0286918 A1* 12/2005 Maeyama et al. ..... 399/45

FOREIGN PATENT DOCUMENTS

| | | | |
|---|---|---|---|
| JP | 11-075067 A | | 3/1999 |
| JP | 11174748 A | * | 7/1999 |
| JP | 2002-072574 A | | 3/2002 |
| JP | 2003-215981 A | | 7/2003 |
| JP | 2005-275250 A | | 10/2005 |
| JP | 2005-280358 A | | 10/2005 |

* cited by examiner

*Primary Examiner*—David M Gray
*Assistant Examiner*—G. M. Hyder
(74) *Attorney, Agent, or Firm*—Rossi, Kimms & McDowell, LLP

(57) ABSTRACT

A method for measuring an amount of toner on a recording medium that can accurately measure the toner amount. Information on the recording medium to which the toner is fixed is acquired. The toner fixed to the recording medium is irradiated with laser light. A light intensity distribution of reflected light of the laser light is detected. The amount of the toner on the recording medium is calculated on the basis of the acquired recording medium information and the detected light intensity distribution.

26 Claims, 18 Drawing Sheets

FIG. 6

| TYPE | RECORDING MEDIUM TYPE | OPTIMUM Sc VALUE |
|---|---|---|
| PRINTER A | RECORDING MEDIUM A | 50(–) |
| | RECORDING MEDIUM B | 52(–) |
| PRINTER B | RECORDING MEDIUM A | 55(–) |
| | RECORDING MEDIUM B | 58(–) |
| PRINTER C | RECORDING MEDIUM A | 75(–) |
| | RECORDING MEDIUM B | 78(+) |
| PRINTER D | RECORDING MEDIUM A | 80(–) |
| | RECORDING MEDIUM B | 84(+) |

| TYPE | OPTIMUM Sc DIFFERENCE (A1−A2) |
|---|---|
| PRINTER A | 70 |
| PRINTER B | 72 |
| PRINTER C | 50 |
| PRINTER D | 40 |

*FIG. 13*

| TYPE | SHEET | OPTIMUM Sc VALUE (A2) | BLANK Sc VALUE (A1) |
|---|---|---|---|
| PRINTER A | RECORDING MEDIUM A | 50 | 120 |
| | RECORDING MEDIUM B | 52 | 122 |
| | RECORDING MEDIUM C | 58 | 128 |

METHOD FOR MEASURING AMOUNT OF TONER, METHOD FOR IMAGE FORMATION, TONER AMOUNT MEASURING APPARATUS, AND IMAGE FORMING APPARATUS

BACKGROUND OF THE INVENTION

1. Field of the Invention

The present invention relates to a method for measuring an amount of toner on a recording medium, a method for image formation, a toner amount measuring apparatus, and an image forming apparatus, and more particularly, to a method for measuring the amount of toner fixed to a recording medium by an image forming apparatus.

2. Description of the Related Art

Conventional copying machines include MFPs (Multi Function Printers) which provide the functions of a printer or a copying machine and which can be connected to a network. In many cases, between such an MFP and an apparatus connected to the MFP via a network, color matching for an image to be printed is carried out or the colors of an image displayed on a display such as a CRT are matched with the colors of an image to be printed. Conventionally, a variety of color management techniques have been disclosed for color matching as described above.

For example, in color management using ICC (International Color Consortium) profiles, an ICC profile unique to an apparatus such as a printer or a copying machine is created so as to enable color matching (calibration or characterization) on the basis of the created ICC profile. Specifically, print data created by a personal computer (hereinafter referred to as a PC) is subjected to a color conversion using an ICC profile. The color-converted data is output to the apparatus corresponding to the ICC profile to match colors of an image to be printed with colors of an image displayed on a display or the like of the PC.

Software that creates a profile for calibration and color measuring instruments has been provided. Thus, environments are being prepared in which users can match colors output by an image forming apparatus such as a printer with target colors.

Some conventional calibrations involve changing the contents of a gamma LUT for gradation without any color conversion using a multi dimensional LUT (gradation correction table) for ICC profiles to obtain desired gradation characteristic.

As described above, color management can suppress a difference in output color between a plurality of apparatuses of the same type or of different types. The scope of applications of the color management is not limited to those described above. For example, the color management is also applicable to the case where colors to be printed by an offset printing machine are matched with colors printed by a printer to allow the printer to be used for color calibration for printing carried out by the offset printing machine. Preparing respective ICC profiles for the offset printing machine and for the printer can realize such color management as shown in FIG. 18 on an application in the PC.

In FIG. 18, the contents of a printing machine ICC profile 510 and of a printer ICC profile 520 are calibrated in association with a color space that does not depend on the printing machine or printer, for example, a CIEL*a*b* color space, on the basis of color measurements of patch images using a color measuring instrument. This enables colors printed by the printing machine to be matched with those printed by the printer. A color management module (CMM) 530 can use these profiles to carry out color conversions to create print data.

Moreover, in the printing industries, it is pursued to heighten the added values of output devices such as printers. For example, the added values have been heightened by using special colors for photographic printing. Specifically, high quality printing with a reduced granular impression and a widened color reproduction range has been achieved by using gray ink as well as orange, violet, and the like as special colors in addition to CMYK basic colors. Ink jet printers using light and special colors and capable of controlling gloss have been provided in order to accomplish high printing quality.

Color management techniques for color measuring instruments and profile creating software need to be improved in order to heighten the added values of output devices. Software capable of creating a profile for up to 10 colors has been provided.

On the other hand, color adjustment by a printer engine involves outputting a patch image with a monochromatic gradation, allowing a reader section to read the patch image to calculate its density, and creating a one-dimensional LUT so as to obtain a desired target (linear density, linear lightness, or the like) as described in, for example, Japanese Laid-Open Patent Publication (Kokai) No. H11-075067. In this color adjustment, white light emitted by the reader section is incident on the output patch image, and the resulting irregularly reflected light is incident on a CCD sensor to allow the image density of the patch image to be detected.

Further, Japanese Laid-Open Patent Publication (Kokai) No. 2002-072574 discloses a technique for forming a patch image on a transfer unit, detecting the application amount (density) of toner (recording material) on the patch image formed using a regular reflection sensor, and feeding back the detected application amount to an LUT or ATR for color adjustments. This can maintain the stability of colors without troubling the user.

Moreover, Japanese Laid-Open Patent Publication (Kokai) No. 2003-215981 discloses a technique for calculating outputs from an irregular reflection sensor and a regular reflection sensor to automatically control the amount of toner used to an optimum value.

For the amount of transparent toner which is difficult to detect using irregularly reflected light, Japanese Laid-Open Patent Publication (Kokai) No. 2005-275250 discloses a technique for using the amount of regularly reflected light from an output image to detect macroscopic glossiness to control the toner amount.

Further, for special colors, Japanese Laid-Open Patent Publication (Kokai) No. 2005-280358 discloses a technique for calculating the recording material amount (the amount of ink applied) on the basis of spectral reflectance data.

However, in order to detect the amounts of toner for all of CMYK, special colors, and transparence, the conventional methods for color adjustment has required not only the optical sensor arrangement for outputting regularly reflected light and irregularly reflected light but also the spectral reflectance sensor for irregularly reflected light, which detects the amount of toner of a special color. This increases apparatus costs and requires a large space in which the sensors are installed, unavoidably increasing the size of the apparatus.

With the method for detecting the density utilizing the light absorption of a toner as disclosed in Japanese Laid-Open Patent Publication (Kokai) No. H11-075067, the accuracy of high density detecting has been insufficient. Two factors contributing to this insufficiency are a method for detecting a toner and a method for image formation.

The reason why the detecting method is a factor will be described in connection with a method for calculating density. The density is measured using the equation shown below, where I1 denotes the intensity of reflected light and I0 denotes the intensity of incident light.

$$\text{Density}=-\log(I1/I0)$$

At a density of 1.0, 10% of incident light is reflected. However, at a high density of 2.0, only 1% of incident light is reflected. FIG. 19 is a diagram showing the relationship between the density of a toner and detected luminance. The axis of abscissa indicates the density, and the axis of ordinate indicates the detected luminance (100×(I1/I0)%). In FIG. 19, reading resolution is set at 8 bits. FIG. 20 is a diagram showing the relationship between the density and the detected luminance with a high density part focused on. As shown in FIG. 20, in the high density part, a variation of 0.5% in detected luminance, that is, a variation of 0.5% in detecting accuracy, varies the density by as much as 0.1. Thus, the conventional method for detecting the density of a toner has not been able to accurately detect the density of a toner particularly at a high density.

The reason why the method for image formation is a factor lies in toner and a fixation system. With an electrophotographic scheme, toners are stacked and melted to develop colors. However, the amount of toner exceeding a specified value prevents an increase in density value (see FIG. 21). The amount of toner exceeding the specified value results in uneven gloss, an unfixed image, or a toner release phenomenon called offset, preventing an increase in density value.

Thus, image forming apparatuses have adjusted colors by measuring the density of an image and adjusting the amount of toner used so as to set the density at a desired value. However, this has resulted in a decrease in the accuracy with which the density of the high density part is detected and a mismatch with the amount of toner used.

Similarly, with the methods for detecting the toner amount disclosed in other publications than the above, the accuracy with which the density of the high density part is detected has been low.

Moreover, with the method for detecting the toner amount using glossiness as described in Japanese Laid-Open Patent Publication (Kokai) No. 2005-275250, it is difficult to accurately control the toner amount without optimizing the type and fixing conditions of paper, the type of toner, the range of potential settings, and the like. Without optimization, the amount of toner used varies. A decrease in the amount of toner used reduces the density and thus the dynamic range, degrading image quality. On the other hand, an increase in the amount of toner used may cause an image defect such as an unfixed image in which the toner is released.

Under these circumstances, it has been desirable to establish a method for accurately measuring the toner amount in order to maintain the specified amount of toner used and to carry out control using the method.

SUMMARY OF THE INVENTION

The present invention provides a method for measuring an amount of toner, a method for image formation, a toner amount measuring apparatus, and an image forming apparatus that can accurately measure the toner amount.

In a first aspect of the present invention, there is provided a method for measuring the amount of toner on a recording medium, the method comprising a recording medium information acquiring step of acquiring information on the recording medium to which the toner is fixed, a light irradiating step of irradiating the toner fixed to the recording medium with laser light, a light intensity distribution detecting step of detecting a light intensity distribution of reflected light of the laser light with which the toner is irradiated, and a toner amount calculating step of calculating the amount of the toner on the recording medium on the basis of the acquired recording medium information and the detected light intensity distribution.

According to the first aspect of the present invention, the toner amount can be accurately measured even though the measured part of the recording medium has a high density, the toner is transparent, or the toner is in a special color. Therefore, the density of toner fixed to the recording medium can be accurately adjusted to a desired density so that a desired image can be formed.

In a second aspect of the present invention, there is provided a method for measuring the amount of toner on a recording medium, the method comprising a light irradiating step of irradiating the recording medium and the toner fixed to the recording medium with laser light, a light intensity distribution detecting step of detecting a light intensity distribution of reflected light of the laser light with which the recording medium and the toner are irradiated, a light intensity distribution comparing step of comparing a light intensity distribution of reflected light from the recording medium with a light intensity distribution of reflected light from the toner, both light intensity distributions being included in the detected light intensity distribution, and a toner amount calculating step of calculating the amount of the toner on the basis of the comparison result of the light intensity distribution comparing step.

In a third aspect of the present invention, there is provided a method for image formation comprising the method for measuring the amount of toner according to the second aspect of the present invention, the method for image formation comprising a toner amount control step of controlling the amount of the toner to be fixed to the recording medium in order to form an image on the recording medium, on the basis of the calculated toner amount.

In a fourth aspect of the present invention, there is provided a toner amount measuring apparatus configured to measure the amount of toner on a recording medium, the apparatus comprising a recording medium information storing unit configured to store information on the recording medium to which the toner is fixed, a light irradiating unit configured to irradiate the toner fixed to the recording medium with laser light, a light intensity distribution detecting unit configured to detect a light intensity distribution of reflected light of the laser light with which the toner is irradiated, and a toner amount calculating unit configured to calculate the amount of the toner on the recording medium on the basis of the stored recording medium information and the detected light intensity distribution.

In a fifth aspect of the present invention, there is provided a toner amount measuring apparatus configured to measure the amount of toner on a recording medium, the apparatus comprising a light irradiating unit configured to irradiate the recording medium and the toner fixed to the recording medium with laser light, a light intensity distribution detecting unit configured to detect a light intensity distribution of reflected light of the laser light with which the recording medium and the toner are irradiated, a light intensity distribution comparing unit configured to compare a light intensity distribution of reflected light from the recording medium with a light intensity distribution of reflected light from the toner, both light intensity distributions being included in the detected light intensity distribution, and a toner amount calculating unit configured to calculate the amount of the toner on the basis of the comparison result provided by the light intensity distribution comparing unit.

In a sixth aspect of the present invention, there is provided an image forming apparatus comprising the toner amount measuring apparatus according to the fifth aspect of the present invention, the image forming apparatus comprising a toner amount control unit configured to control the amount of the toner to be fixed to the recording medium in order to form an image on the recording medium, on the basis of the calculated toner amount.

The above and other objects, features, and advantages of the invention will become more apparent from the following detailed description taken in conjunction with the accompanying drawings.

BRIEF DESCRIPTION OF THE DRAWINGS

FIGS. 3A and 3B are diagrams showing the relationship between light intensity detected by each pixel in a CCD sensor in FIG. 2 and average light intensity, wherein FIG. 3A is a diagram showing an example of the relationship between the detected light intensity and the average light intensity, and FIG. 3B is a diagram showing another example of the relationship between the detected light intensity and the average light intensity.

FIG. 6 is a diagram showing optimum Sc value data stored in an HDD in a PC in FIG. 2.

FIG. 13 is a diagram showing the optimum Sc value and the Sc value of the recording medium used in a variation of the second embodiment of the present invention.

DETAILED DESCRIPTION OF THE PREFERRED EMBODIMENTS

The present invention will now be described in detail with reference to the drawings showing preferred embodiments thereof.

Description will be given of a method for measuring the amount of toner according to a first embodiment of the present invention.

First, with reference to FIGS. 1 and 2, description will be given of a toner amount measuring apparatus carrying out the method for measuring the amount of toner according to the first embodiment of the present invention.

Figure 1:
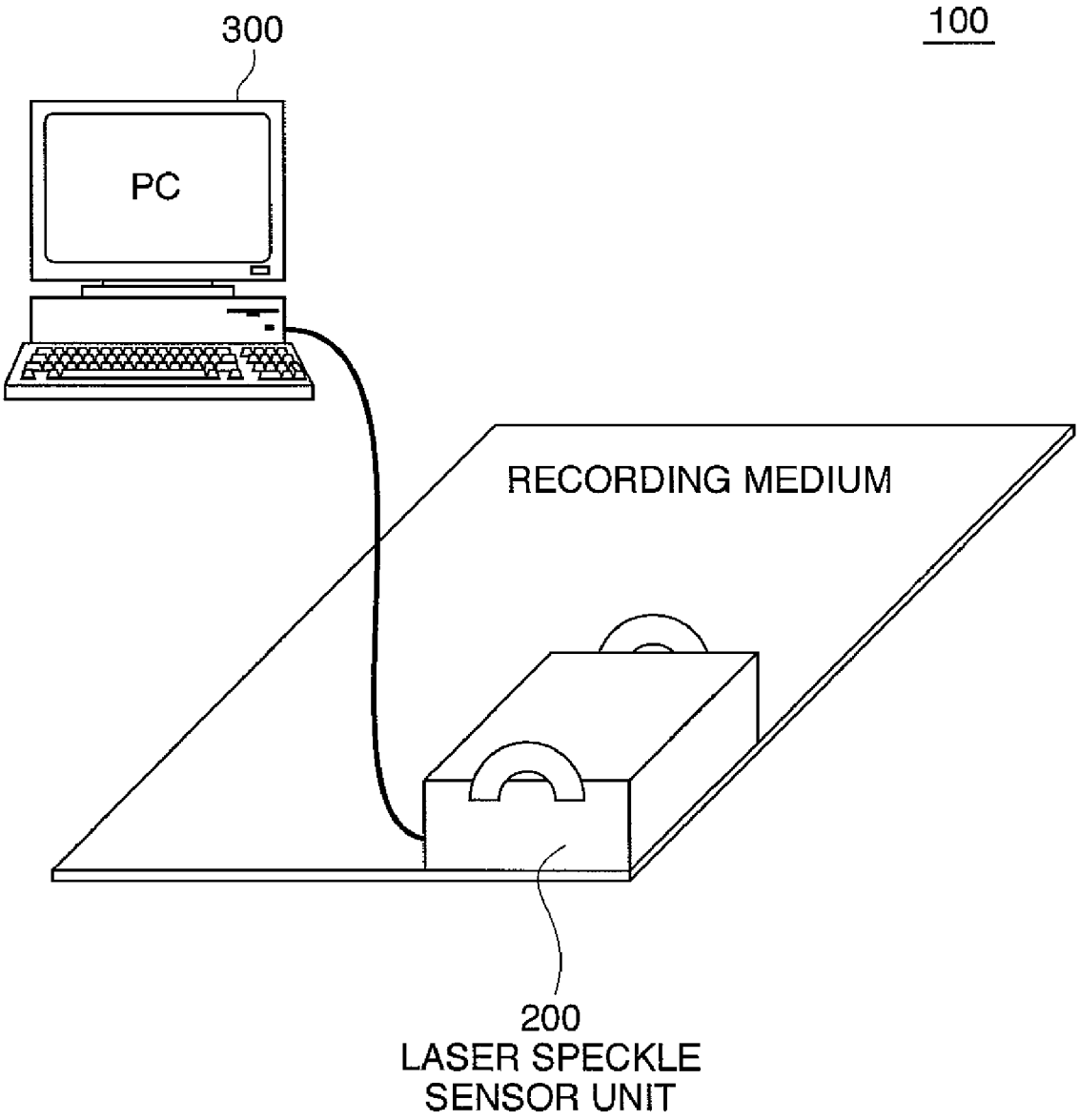
FIG. 1 is a diagram schematically showing the construction of a toner amount measuring apparatus carrying out a method for measuring the amount of toner according to a first embodiment of the present invention.

FIG. 1 is a diagram schematically showing the construction of a toner amount measuring apparatus 100 carrying out the method for measuring the amount of toner according to the first embodiment of the present invention. FIG. 2 is a block diagram showing the internal construction of the toner amount measuring apparatus 100 in FIG. 1.

As shown in FIG. 1, the toner amount measuring apparatus 100 comprises a laser speckle sensor unit 200 and a PC 300. The laser speckle sensor unit 200 and the PC 300 are communicatively connected together.

The laser speckle sensor unit 200 is a sensor used to carry out what is called a calibration which determines the density of an output image from an image forming apparatus, that is, the amount of a toner P such as toner (hereinafter referred to as the "toner amount").

Figure 2:
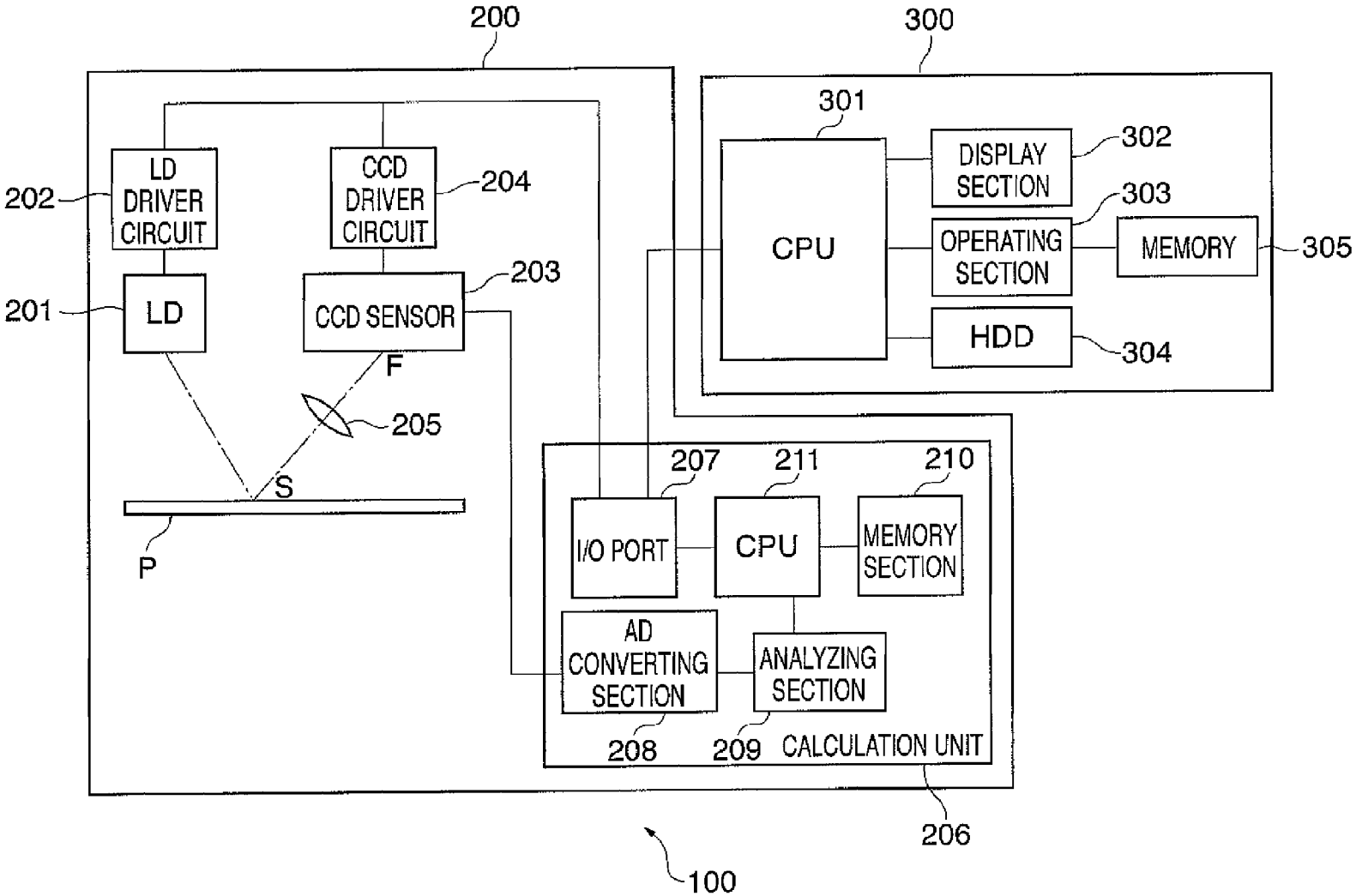
FIG. 2 is a block diagram showing the internal construction of the toner amount measuring apparatus in FIG. 1.

As shown in FIG. 2, the laser speckle sensor unit 200 comprises a laser diode 201 (hereinafter referred to as an LD), an LD driver circuit 202 that controls the LD 201, a CCD sensor 203, a CCD driver circuit 204 that controls the CCD sensor 203, a lens 205, and an calculation unit 206.

In the laser speckle sensor unit 200, a laser beam output by the LD 201 is extended by a lens or the like (not shown) so as to increase its beam spot diameter to about 10 mm. An irradiation spot S is formed on the toner P formed on an irradiation target, for example, a recording medium. The toner P has microscopic recesses and projections. Consequently, the laser beam is randomly scattered from the irradiation spot S depending on the recesses and projections, that is, the attributes (recesses and projections and the like) of the toner P.

The laser light scattered from the irradiation spot S travels through a free space and is formed into an image on the CCD sensor 203 by the lens 205 to provide a formed image F. The scattered laser beams interfere with one another on a light receiving surface of the CCD sensor 203 so that the formed image F is provided with a random speckle pattern. The CCD sensor 203 converts the light intensity distribution of the formed image F into an electric signal and outputs the signal to the calculation unit 206.

As shown in FIG. 2, the calculation unit 206 comprises an I/O port 207 through which data is transmitted to and received from an external apparatus, an A/D converting section 208, an analyzing section 209, a memory section 210, and a CPU 211.

The I/O port 207 is connected to an LD driver circuit 202 and a CCD driver circuit 204 to transmit and receive control signals and the like which control the LD driver circuit 202 and CCD driver circuit 204. The I/O port 207 is connected to a CPU 301 of the PC 300 to transmit and receive control signals and the like to and from the PC 300.

The A/D converting section 208 subjects an electric signal indicating the light intensity distribution of the formed image F detected by the CCD sensor 203, to an A/D conversion to obtain a digital signal. The analyzing section 209 analyzes the characteristics of the speckle pattern in the digital signal resulting from the A/D conversion and indicating the light intensity distribution of the formed image F.

The memory section 210 includes a volatile memory and a nonvolatile memory to store various data. The CPU 211 controls the component parts of the laser speckle sensor unit 200 in accordance with the contents of a control program stored in the nonvolatile memory of the memory section 210. For example, the CPU 211 receives control signals from the PC 300 via the I/O port 207 to start detecting the toner amount, transmit the detected toner amount, end detecting of the toner amount, and carry out other operations on the basis of the control signal.

As shown in FIG. 2, the PC 300 comprises the CPU 301 that controls the component parts of the PC 300, a display section 302, an operating section 303, a hard disk drive (HDD) 304, and a memory 305.

Now, the operation of the laser speckle sensor unit 200 will be described.

As described above, in the laser speckle sensor unit 200, the LD 201 irradiates the toner P with laser light and reflected light from the toner P is formed into an image on the CCD sensor 203 via the lens 205. The light intensity distribution (speckle pattern) of the image F formed on the CCD sensor 203 is detected. The analyzing section 209 analyzes the detected light intensity distribution to calculate an Sc value described below. Then, on the basis of the Sc value, the toner amount on the toner P is calculated. A specific description will be given below.

In the present embodiment, the CCD sensor 203 is assumed to be comprised of N pixels. Here, the light intensity detected by the nth pixels of the CCD sensor 203 is defined as In. Then, the average value <I> of the light intensities I detected by all the pixels of the CCD sensor 203 is calculated by:

$$< I >= \frac{1}{N}\sum_{N} I_n \qquad \text{[Formula 1]}$$

Figure 3A:
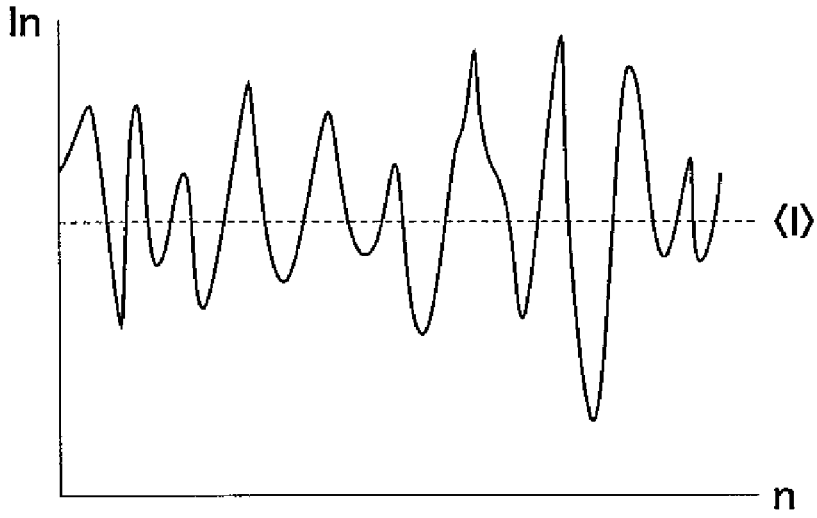

If the surface of the toner P is very rough, the light intensity distribution of the formed image F detected by the CCD sensor 203 is as shown in FIG. 3A. That is, the light intensities In detected by the pixels vary relative to the average value <I>.

Figure 3B:
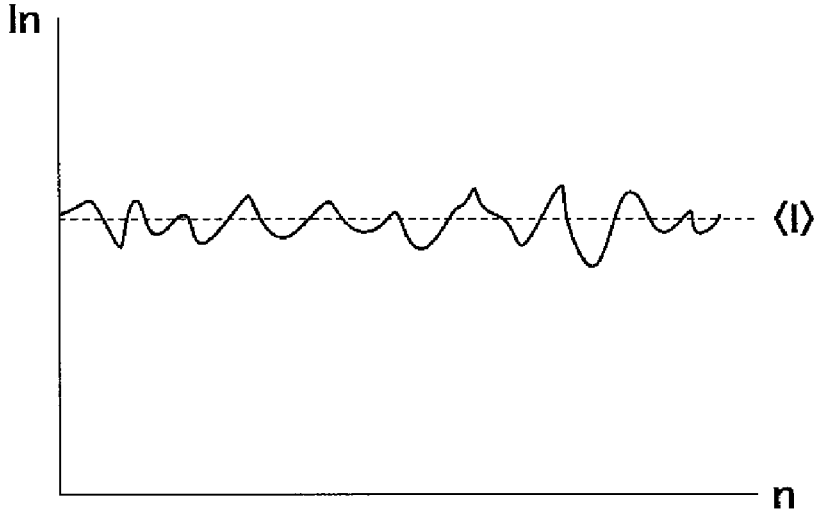

On the other hand, if the surface of the toner P is very smooth, the light intensity distribution of the formed image F detected by the CCD sensor 203 is as shown in FIG. 3B. That is, the variation in the light intensities In detected by the pixels decreases relative to the average value <I>.

Utilizing this, the analyzing section 209 calculates the Sc value expressed by Formula 2, shown below. Then, on the basis of the Sc value, the analyzing section 209 calculates the toner amount on the toner P as described below.

$$Sc = \frac{A \times \frac{1}{N}\sum_{N} | < I > - I_n |}{< I >} \qquad \text{[Formula 2]}$$

In Formula 2, A is a predetermined constant. As shown in Formula 2, the Sc value is proportional to the ratio, to the average light intensity <I>, of the average value of the differences between the light intensities In detected by the pixels of the CCD sensor 203 and the average light intensity <I>. In this case, as described above, the variation among the light intensities In detected by the pixels of the CCD sensor 203 relative to the average light intensity <I> corresponds to the surface roughness of the toner P. Accordingly, the Sc value indicates the surface roughness of the toner P. Thus, the predetermined constant A is set at, for example, a value indicating the ratio of the surface roughness of the toner to the ratio, to the average light intensity <I>, of the difference between the light intensities In detected by the pixels of the CCD sensor 203 and the average light intensity <I>. The constant A is experimentally preset.

A large Sc value indicates that the surface of the toner P at the irradiation spot S is rough. In contrast, a small Sc value indicates that the surface of the toner P at the irradiation spot S is smooth.

The analysis data such as the Sc value calculated by the analyzing section 209 as described above is stored in the memory section 210 via the CPU 211.

The PC 300 controls the laser speckle sensor unit 200 and compares data received from the calculation unit 206 with data stored in the HDD 304 to calculate the toner amount on the toner P. The data stored in the HDD 304 is pre-input via the display section 302 and through use of a pointing device or the like of the operating section 303. The data includes information on the paper type of the recording medium to which the toner P is fixed and information on the image forming apparatus. On the basis of these pieces of information in the HDD 304 and the calculated Sc value, the PC 300 calculates the toner amount on the toner P. A specific description will be given of a method for calculating the toner amount on the toner P.

The toner amount measuring apparatus 100 calculates the toner amount on the toner P by retrieving the toner amount corresponding to the Sc value calculated as described above on the basis of the relationship between the preset toner amount and the Sc value.

Figure 4:
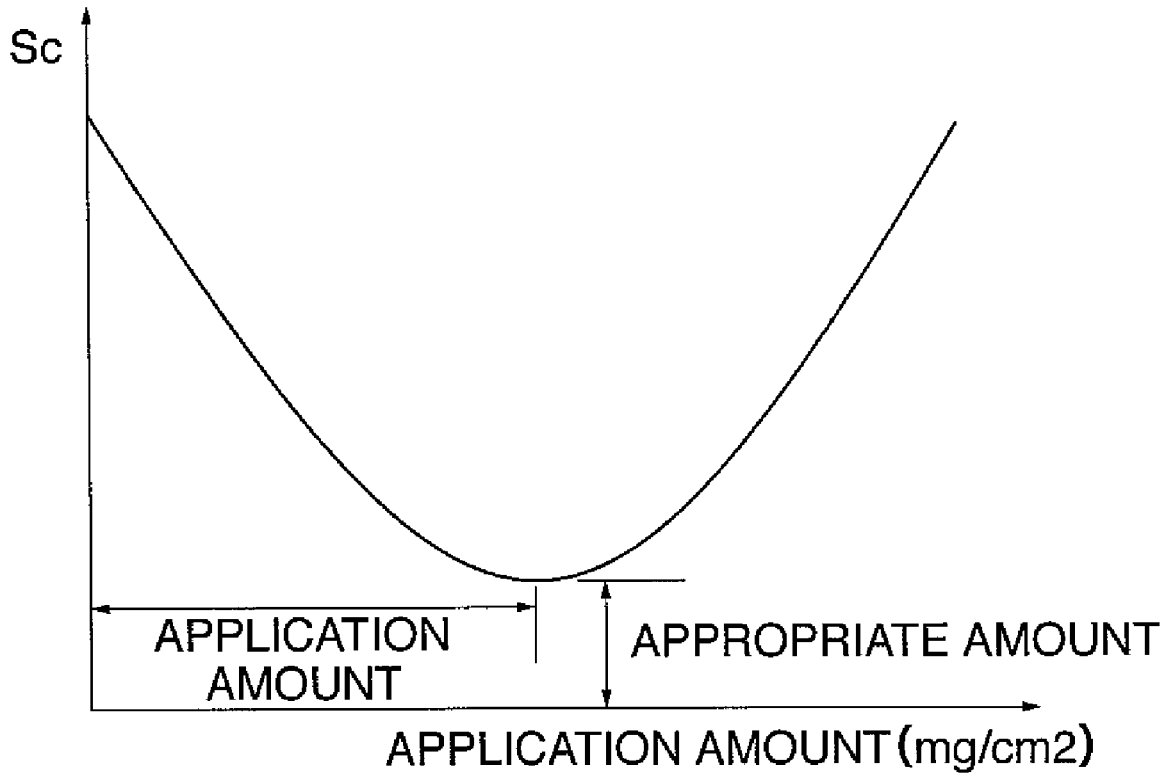
FIG. 4 is a diagram showing the relationship between the toner amount of toner fixed to plain paper and an Sc value.

The relationship between the toner amount, for example, the amount of toner on the recording medium, and the Sc value is as shown in FIG. 4. FIG. 4 shows the relationship between the toner amount on the toner P fixed to plain paper (the amount of toner on the recording medium) and the Sc value. That is, owing to the surface roughness of plain paper, the Sc value increases with decreasing amount of toner, that is, decreasing amount of toner. The Sc Value decreases with increasing amount of toner. The Sc value is minimized when the amount of toner is close to its appropriate value. A further increase in toner amount results in an unfixed image or an offset image, increasing the Sc value again.

In the present embodiment, the image forming apparatus is used to fix any amount of toner to a recording medium (see FIG. 5) and the toner amount measuring apparatus 100 calculates the Sc value of the toner to create Sc value data (see FIG. 4) indicating the relationship between each toner amount and the corresponding Sc value. The calculated Sc value data is stored in the HDD 304. The Sc value data is, for example, table data or map data. Further, since the attributes of the recording medium such as surface roughness vary depending on the type of the recording medium, the relationship between the toner amount and the corresponding Sc value varies depending on the type of the recording medium. Thus, Sc value data is created for each recording medium type and stored in the HDD 304. In the present embodiment, it is assumed that Sc value data on recording media A and B is stored in the HDD 304 of the PC 300.

Figure 5:
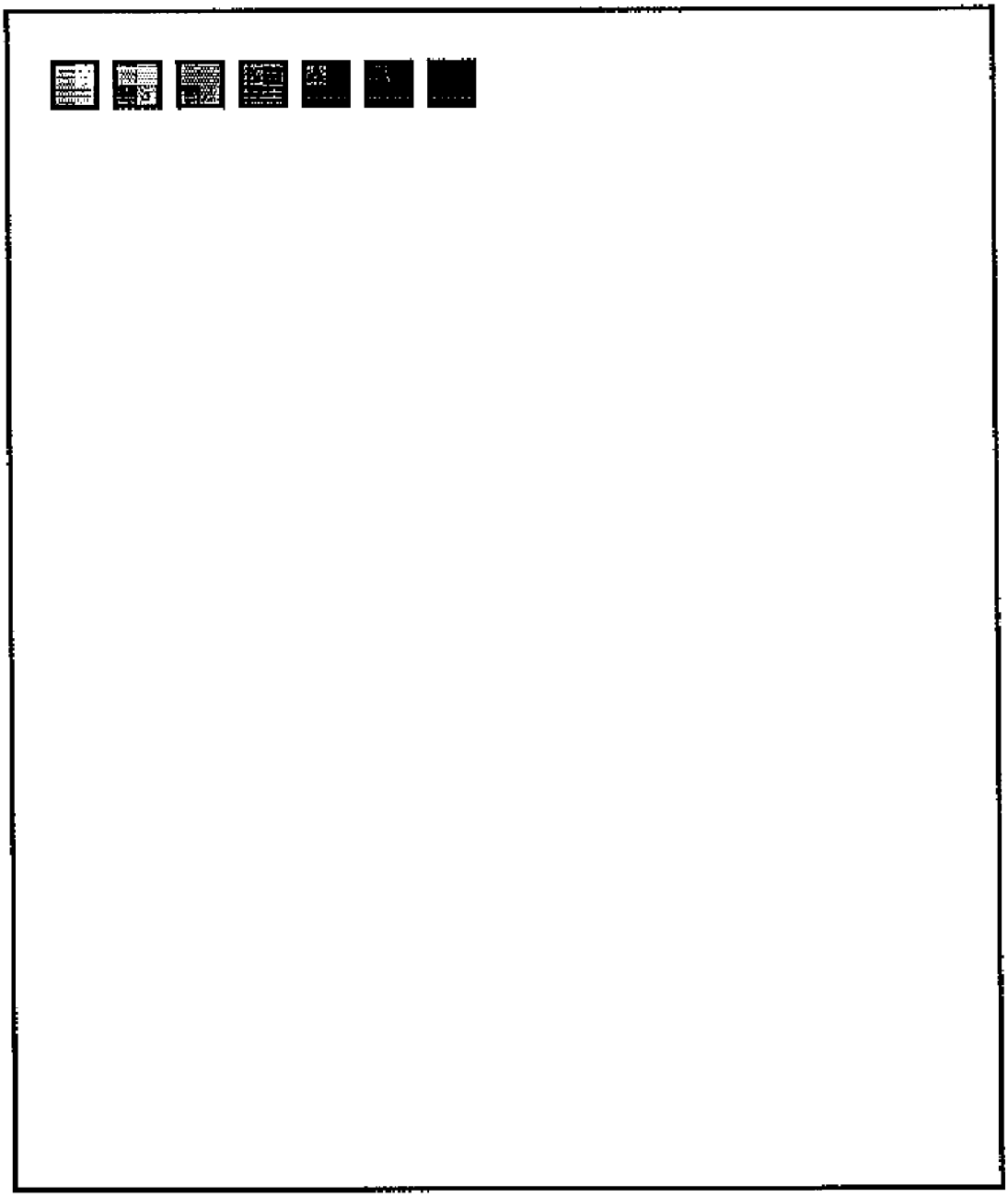
FIG. 5 is a diagram showing an example of patch images used in the toner amount measuring apparatus in FIG. 1.

Sc value data is obtained by, for example, as shown in FIG. 5, using different amounts of a predetermined number of, for example, seven toners for a predetermined single color to form patch images, reading the patch images into the toner amount measuring apparatus 100 to calculate each Sc value, and then calculating the relationship between the toner amount and the corresponding Sc value through interpolation or the like.

The HDD 304 of the PC 300 stores optimum Sc value data including optimum Sc values set for the respective types of image forming apparatus (printer) and recording medium so as to optimize the toner amount of fixed toner in a standard output for a predetermined color as shown in FIG. 6. The term "standard output" refers to an output using the optimum amount of toner in a predetermined single color for the image forming apparatus as described below.

The optimum value of the amount of toner fixed in the standard output for the predetermined color varies depending on the type of the image forming apparatus that outputs the toner. This is because color reproduction range, maximum application amount, fixing property, surface characteristics, and the like vary depending on the type of image forming apparatus. Further, as described above, the relationship between the toner amount and the Sc value varies depending on the type of recording medium. Thus, as shown in FIG. 6, the HDD 304 stores the optimum Sc value data including the optimum Sc values for the respective types of image forming apparatus and recording medium.

In the present embodiment, it is assumed that the HDD 304 of the PC 300 stores the optimum Sc value data including the optimum Sc value for a standard output of a toner of a predetermined color, for two types of recording medium (recording media A and B) for four types of image forming apparatus (printers A, B, C, and D).

Figure 7:
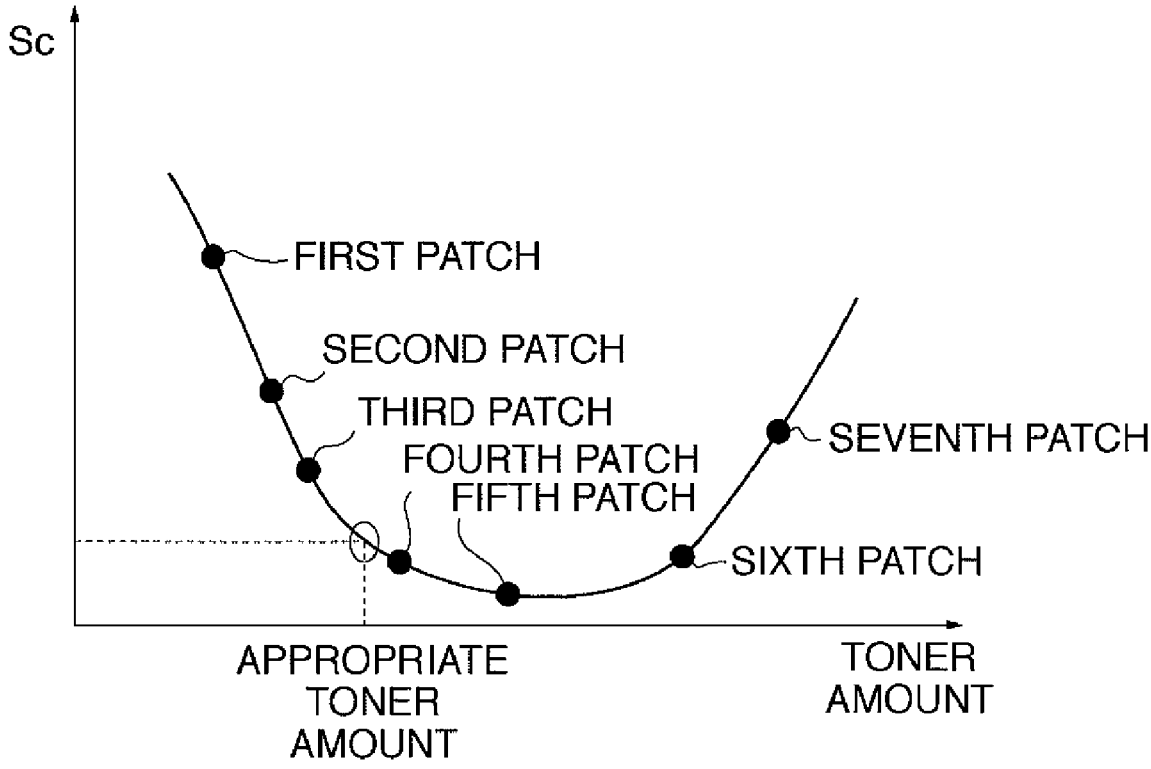
FIG. 7 is a diagram illustrating the relationship between the toner amount of toner and the Sc value.

In FIG. 6, the + or − sign following the optimum Sc value indicates the inclination of the relationship between the toner amount and the Sc value. As shown in FIG. 7, the relationship between the toner amount and the Sc value is expressed by a lower projecting quadratic curve as described above (see FIG. 4). If the Sc value is not located at the bottom value (inflection point) of the relation line, two corresponding toner amounts exist so that a single optimum toner amount cannot be set even by specifying an Sc value. Consequently, resulting from the calculation, two optimum toner amounts, one of which is more than the other thereof, are specified. In contrast to this, by adding the corresponding sign to the Sc value, a single optimum toner amount can be specified.

Figure 8:
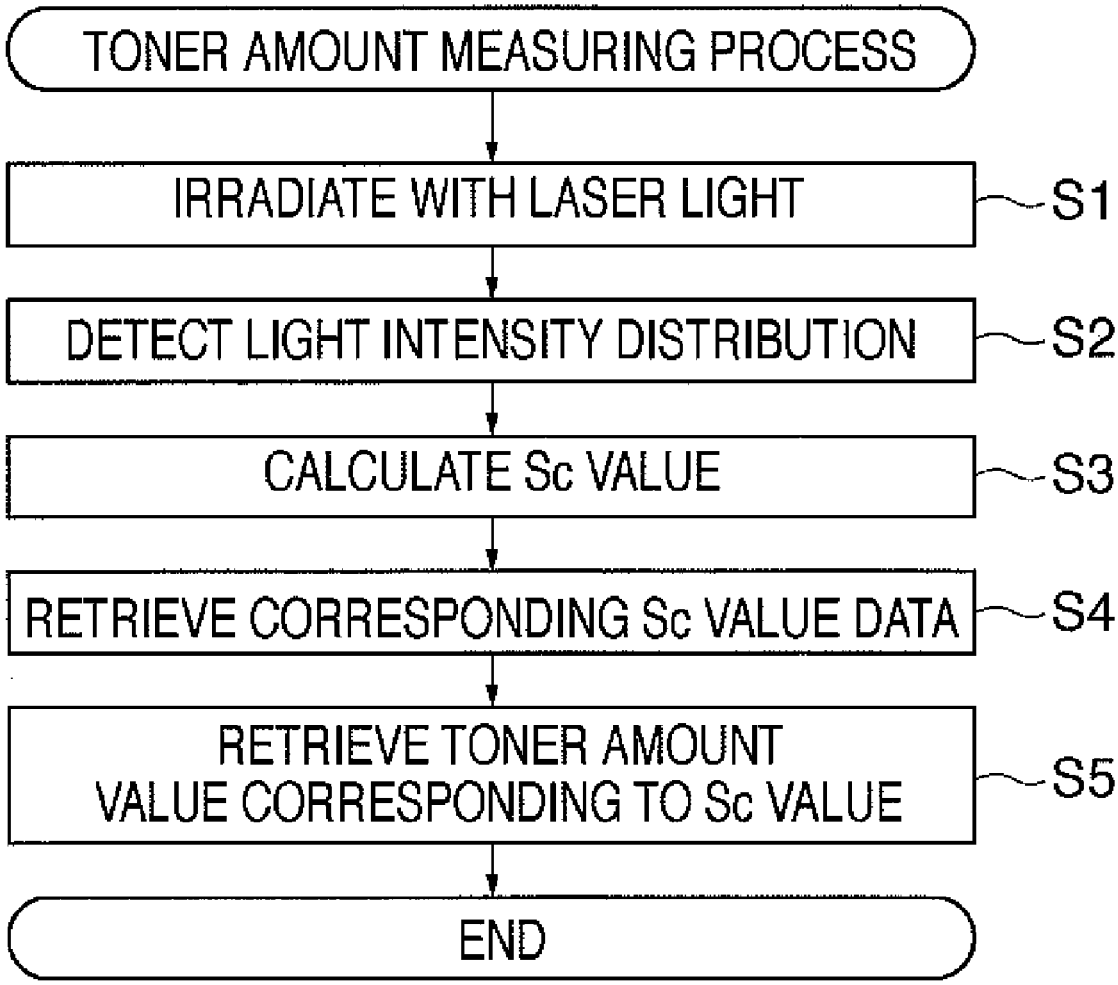
FIG. 8 is a flowchart of a process for measuring the amount of toner which process is carried out by the toner amount measuring apparatus in FIG. 1.

With reference to FIG. 8, description will be given of a toner amount measuring process carried out by the toner amount measuring apparatus 100. FIG. 8 is a flowchart of the toner amount measuring process carried out by the toner amount measuring apparatus 100.

The present process is started by the user carrying out, via the operating section 303 of the PC 300 or the like, an operation for instructing a toner amount measuring process to be started. First, in the laser speckle sensor unit 200, the LD 201 outputs laser light to irradiate the toner P the toner amount of which is to be measured, with the laser light (step S1). Reflected light from the toner P irradiated with the laser light is formed, via the lens 205, into a formed image F on the light receiving surface of the CCD sensor 203. The CCD sensor 203 detects the light intensity distribution of the formed image F (step S2). The A/D converting section 208 then converts a signal indicating the detected light intensity distribution into a digital signal. On the basis of this signal, the analyzing section 209 uses Formula 2 to calculate an Sc value for the toner P (step S3).

Then, the calculated Sc value is output to the PC 300, in which the CPU 301 retrieves the Sc value data corresponding to the recording medium to which the toner P is fixed, from the HDD 304 (step S4). In step S4, for example, on the basis of recording medium information pre-input by the user via the operating section 303 or the like, the CPU 301 retrieves the Sc value data corresponding to the recording medium to which the toner P is fixed. Then, on the basis of the Sc value data retrieved in step S4, the toner amount value corresponding to the Sc value calculated in step S3 is retrieved (step S5). Then, the toner amount value is displayed on, for example, the display section 302 and the present process is finished.

In step S5, the inclination of the Sc value calculated in step S3, that is, the inclination of the relation line between the toner amount and the Sc value is taken into account. This allows the determination of the single toner amount corresponding to the calculated Sc value. In step S5, for example, as shown in FIG. 5, a plurality of patch images for different toner amounts including one for which the toner amount is to be measured are formed and read in to detect the inclination. The inclination can be detected by, for example, a simple calculation involving the determination of whether the Sc value for the next patch to be detected is large or small. In FIG. 7, the first to fourth patches exhibit Sc values with minus inclinations and the subsequent patches exhibit Sc values with plus inclinations.

As described above, in the method for measuring the amount of toner according to a first embodiment of the present invention, the speckle pattern of laser speckles formed depending on the surface attributes of the toner is detected and Formula 2 is used to accurately calculate the surface roughness corresponding to the speckle pattern. Since the surface roughness of the toner corresponds to the toner amount, the toner amount can be accurately calculated from the calculated surface roughness. Thus, the toner amount measuring apparatus 100 can accurately detect the surface roughness of the toner and thus accurately measure the toner amount. Further, the toner amount corresponds to the surface roughness not only in common toners but also in special-color and transparent toners. Accordingly, the toner amount measuring apparatus can also accurately detect the surface roughness of these toners. Thus, compared to conventional toner amount measuring apparatuses that detect the toner amount on the basis of color information on the toner, the toner amount measuring apparatus 100 can accurately measure the toner amounts not only of common toners but also of special-color and transparent printing materials.

For simplification, in the above description, the toner amount measuring apparatus 100 comprises Sc value data (see FIG. 4) on two types of recording medium, the recording media A and B. However, the toner amount measuring apparatus 100 may comprise Sc value data on more types of recording medium. This allows the toner amount to be accurately measured for more types of recording medium. Further, in the above description, the toner amount measuring apparatus 100 comprises the optimum Sc value data (FIG. 6) on two types of recording medium (recording media A and B) for four types of image forming apparatuses (printers A to D). However, the toner amount measuring apparatus 100 may comprise optimum Sc value data on more types of image forming apparatus and recording medium. This allows the toner amount to be accurately measured for more types of image forming apparatus and recording medium.

The toner amount measuring apparatus 100 may provide a function for adjusting the amount of toner to be fixed to an optimum value as described below.

Figure 9:
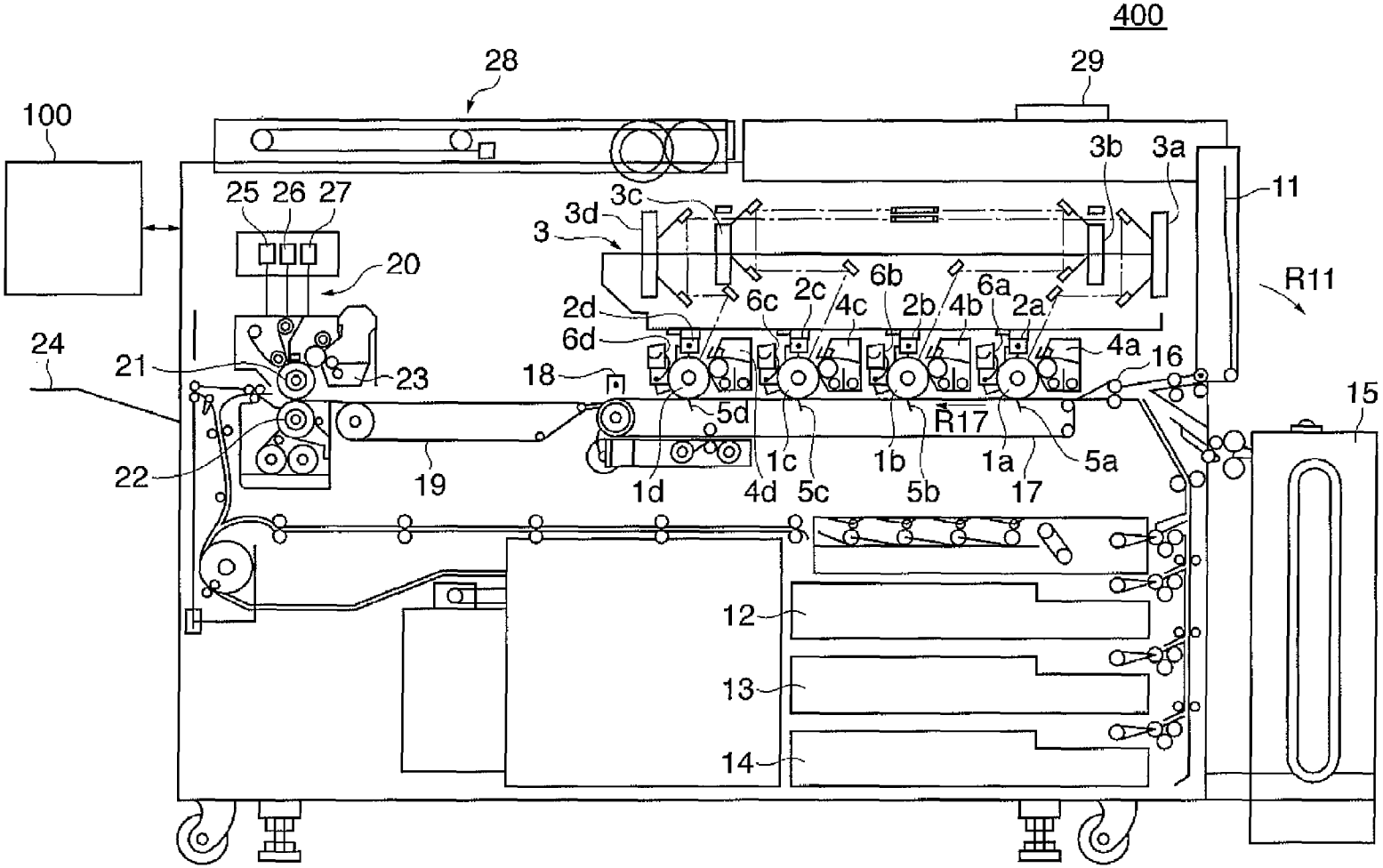
FIG. 9 is a sectional view schematically showing the construction of an image forming apparatus comprising the toner amount measuring apparatus in FIG. 1.

Now, description will be given of the image forming apparatus comprising the toner amount measuring apparatus 100. FIG. 9 is a sectional view schematically showing the construction of an image forming apparatus 400 comprising the toner amount measuring apparatus 100.

The image forming apparatus 400 is an electrophotographic four-full-color laser beam printer. As shown in FIG. 9, the image forming apparatus 400 has four image forming stations that form images in magenta, cyan, yellow, and black.

As shown in FIG. 9, the image forming station comprises electrophotographic photosensitive units (hereinafter referred to as photosensitive drums) 1*a*, 1*b*, 1*c*, and 1*d*, that are image bearing members supported so as to be rotatable clockwise in the figure. The photosensitive drums 1*a*, 1*b*, 1*c*, and 1*d* are rotated clockwise in the figure at a predetermined process speed (peripheral speed). Primary chargers 2*a*, 2*b*, 2*c*, and 2*d*, developing devices 4*a*, 4*b*, 4*c*, and 4*d*, transfer chargers 5*a*, 5*b*, 5*c*, and 5*d*, and cleaning devices 6*a*, 6*b*, 6*c*, and 6*d* are sequentially arranged around the periphery of the photosensitive drums 1*a*, 1*b*, 1*c*, and 1*d* in their rotating direction. The image forming station comprises exposure devices 3*a*, 3*b*, 3*c*, and 3*d* that expose the photosensitive drums 1*a*, 1*b*, 1*c*, and 1*d*. In the description below, in the case where the above members or devices are generically named or the colors need not be distinguished from one another, they are simply represented as the photosensitive drum 1, primary charger 2, exposure device 3, developing device 4, transfer charger 5, and cleaning device 6.

A transfer belt 17 is disposed between the developing devices 4*a*, 4*b*, 4*c*, and 4*d* and the cleaning devices 6*a*, 6*b*, 6*c*, and 6*d* under and in contact with the photosensitive drums 1*a*, 1*b*, 1*c*, and 1*d*. The transfer belt 17 rotates in the direction of arrow R17 with a recording medium such as paper or a transparent film beared on its surface and sequentially conveys the recording medium toward the photosensitive drums 1*a*, 1*b*, 1*c*, and 1*d*. Toner images formed on the photosensitive drums 1*a*, 1*b*, 1*c*, and 1*d* in the respective image forming stations are sequentially transferred to the recording medium on the transfer belt 17 by the transfer chargers 5*a*, 5*b*, 5*c*, and 5*d*.

The image forming apparatus 400 has a plurality of sheet feeding sections, that is, sheet feeding cassettes 12, 13, and 14, and a manual sheet feeding tray 11 that is pivotable in the direction of arrow R11 in FIG. 9, and a mass paper deck 15. The recording medium is fed from one of the sheet feeding sections to the transfer belt 17 via a sheet feeding roller, a conveying roller, and a registration roller 16.

Toner images in respective colors formed on the respective photosensitive drums 1*a*, 1*b*, 1*c*, and 1*d* are sequentially transferred to the recording medium supported on the transfer belt 17 and passing through the image forming stations. Once this transfer step is finished, the recording medium is separated from the transfer belt 17 by a separating charger 18 and conveyed to a fixing device 20 by a conveying belt 19 constituting recording medium guiding means.

The fixing device 20 comprises a rotatably supported fixing roller 21, a pressurizing roller 22 that rotates in pressure contact with the fixing roller 21, a releasing agent applying device 23 that is releasing agent supplying and applying means, and a roller cleaning device (not shown). A heater (not shown) such as a halogen lamp is disposed inside each of the fixing roller 21 and pressurizing roller 22. Each of the fixing roller 21 and pressurizing roller 22 is in contact with a thermistor (not shown) so that voltages supplied to the heaters are controlled by a temperature adjusting device (not shown) to adjust the surface temperatures of the fixing roller 21 and pressurizing roller 22. The pressurization value of the pressurizing roller 22 and the surface temperature of the fixing roller 21 can be varied by a fixation control mechanism 25.

A speed control device 27 is connected to driving motors (not shown) that drive the fixing roller 21 and pressurizing roller 22. The speed control device 27 controls the speed at which the recording medium is conveyed, that is, the rotation speed of the fixing roller 21 and pressurizing roller 22, which pressurize and heat the opposite surfaces of the recording medium. This allows the unfixed toner images on the surface of the recording medium to be melted and fixed to the recording medium to form a full color image on it. The recording medium with the full color image fixed thereto is separated from the pressurizing roller 22 by a separating pawl (not shown) and discharged onto a sheet discharging tray 24.

An original reading section 28 and an operation display 29 are disposed at the top of the image forming apparatus 400 shown in FIG. 9. The original reading section 28 optically scans and reads an original on a copy board (not shown) to obtain image signals for the respective colors. The operation display 29 is used by the user (operator) to input commands and reports the status of the apparatus to the user.

The image forming apparatus 400 also comprises the toner amount measuring apparatus 100 in FIG. 1. As shown in FIG. 9, the toner amount measuring apparatus 100 is communicatively connected to the image forming apparatus 400. The image forming apparatus 400 can adjust the toner amount for the standard output by using the toner amount measuring apparatus 100 to carry out a toner amount adjusting process. Now, the toner amount adjusting process will be described.

As disclosed in Japanese Laid-Open Patent Publication (Kokai) No. H06-11936, the toner amount adjusting process carries out potential control that determines a desired charging potential and a desired development potential. Specifically, charging conditions are adjusted so that the toner amount of the output toner has a desired value at the standard value of the laser power (hereinafter referred to as the LPW) of laser light output by the exposure devices 3*a*, 3*b*, 3*c*, and 3*d*.

In the present process, first, the image forming apparatus 400 outputs a plurality of patch images with different toner amounts (toner application amounts). For example, as shown in FIG. 5, patch images in a predetermined single color are output at the standard LPW value and at LPW values greater or smaller than the standard value by up to 30% of the standard value at intervals of 10%. That is, patch images in a predetermined color having seven types of toner amount (density) are output at the standard LPW value, LPW values 10%, 20%, and 30% smaller than the standard value, and LPW values 10%, 20%, and 30% greater than the standard value. The standard LPW value is desirably 128 levels (80 hexa) for 8 bits because it varies up to 30% in both the plus and minus directions at intervals of 10% in connection with the constitution of the patch images in FIG. 5, described above.

Then, the laser speckle sensor unit 200 reads in the patch images and calculates Sc values for the patch images to change the standard LPW value so that an image with the desired toner amount can be formed at the standard LPW value.

That is, the laser speckle sensor unit 200 transmits the LPW values corresponding to the calculated Sc values of the respective patch images to the PC 300. On the basis of information received from the laser speckle sensor unit 200, the PC 300 calculates the relationship between the Sc values and the LPW values to retrieve the LPW value corresponding to the optimum Sc value shown in FIG. 6. In the retrieval of the LPW value, the inclination (±) of the optimum Sc value is taken into account. The relationship between the LPW value and Sc value calculated by the PC 300 has characteristics similar to those of the relationship between the Sc value and the toner amount shown in the graph in FIG. 7; the intensity of the LPW (LPW value) replaces the toner amount. Thus, the LPW value varies depending on the inclination of the Sc value, thus requiring the inclination of the Sc value to be specified so as to retrieve the optimum Sc value. Further, the LPW value corresponding to the optimum Sc value is, for example, calculated through various interpolations using the LPW values corresponding to the Sc values detected in the patch images in FIG. 5.

As described above, the Sc value varies depending on the type of recording medium on which patch images are formed, and the optimum Sc value varies depending on the type of image forming apparatus. To calculate the above standard LPW value, it is necessary to specify the type of recording medium on which the patch images are formed and the type of image forming apparatus that has formed the patch images.

As a result, such an LPW value as provides the preset optimum Sc value is calculated. Setting the LPW value calculated to be the standard LPW value enables the optimum toner amount to be determined. Further, each LPW value is set equal to ±30% of the standard LPW value. Thus, setting the standard LPW value sets the range of the LPW value and the maximum and minimum LPW values. This allows the maximum and minimum toner amounts to be set.

Figure 10:
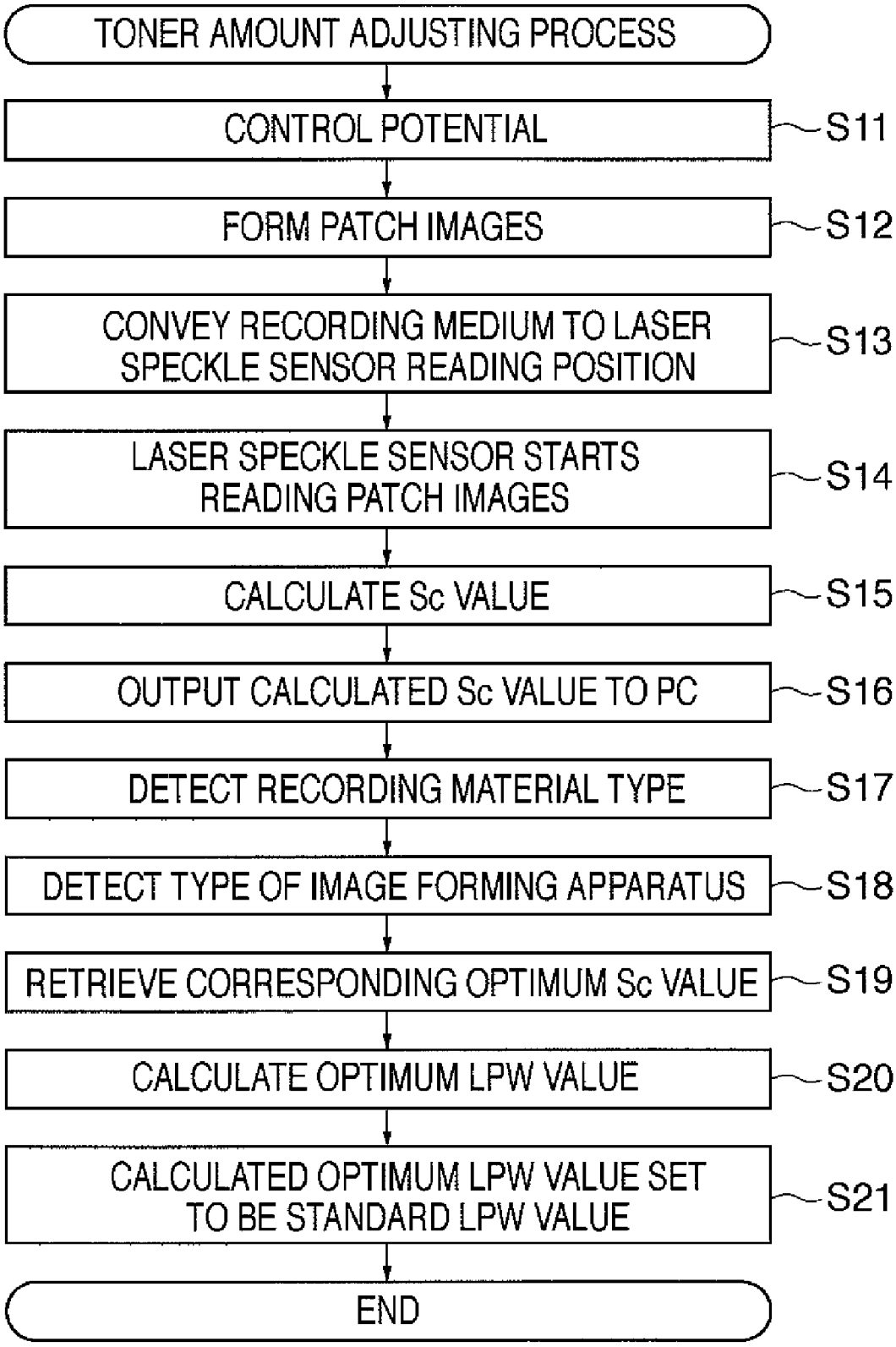
FIG. 10 is a flowchart of a process for measuring the amount of toner which process is carried out by the image forming apparatus in FIG. 9.

Now, the toner amount adjusting process will be described in detail with reference to FIG. 10. FIG. 10 is a flowchart of a toner amount adjusting process carried out by the image forming apparatus 400.

The present process is started by the user carrying out, via the operating section 303 of the PC 300 or the like, an operation for instructing a toner amount measuring process to be carried out. First, the image forming apparatus 400 carries out potential control to vary the LPW value of the exposure device 3 for a predetermined color as described above (step S11) In step S11, as described above, to form the patch images in FIG. 5, the photosensitive drum 1 is exposed with the LPW value of the exposure device 3 for the predetermined color sequentially set equal to 30%, 20%, and 10% smaller than the standard LPW value, then at the standard valuer and then equal to 10%, 20%, and 30% greater than the standard LPW value.

Then, a predetermined recording medium is fed and patch images corresponding to electrostatic latent images exposed in step S11 are formed on the recording medium. The recording medium is then output to the sheet discharging tray (step S12). In step S12, as shown in FIG. 5, for examples seven types of patch image with different densities (toner amounts) are formed.

Then, the output recording medium is conveyed to a reading position in the laser speckle sensor unit 200 (step S13). In step S13, the user manually conveys the output recording medium to the reading position in the laser speckle sensor unit 200. Alternatively, an automatic conveying device (not shown) may be mounted in the image forming apparatus 400 to convey the output recording medium to the reading position in the laser speckle sensor unit 200. This reduces the user's burdens.

Once the output recording medium is conveyed to the reading position in the laser speckle sensor unit 200, reading of the patch images formed on the recording medium is sequentially started (step S14). Upon reading all the patch images formed, the laser speckle sensor unit 200 allows the analyzing section 209 to calculate Sc values for the respective patch images as described above (see FIG. 8) (step S15). Upon calculating the Sc values of the respective patch images, the laser speckle sensor unit 200 transmits each of the calculated Sc values to the PC 300 for the corresponding patch (step S16). At this time, the laser speckle sensor unit 200 transmits to the PC 300 the LPW values corresponding to the respective patch images in association with the calculated Sc values.

Upon receiving the Sc values from the laser speckle sensor unit 200, the PC 300 detects the type of the predetermined recording medium on which the patch images are formed (step S17). In step S17, the type of recording medium is detected by retrieving the recording medium conditions input by the user using a keyboard, a pointing device, or the like of the operating section 303. Alternatively, the detection may be carried out by receiving information indicative of the type of recording medium from the image forming apparatus 400.

Then, the PC 300 detects the type of image forming apparatus 400 (step S18). In step S18, the type of image forming apparatus is detected by retrieving the image forming apparatus conditions input by the user using the keyboard, the pointing device, or the like of the operating section 303. Alternatively, the detection may be carried out by receiving information indicative of the type of image forming apparatus 400 from the image forming apparatus 400 itself.

Then, the PC 300 retrieves the optimum Sc value corresponding to the types of recording medium and image forming apparatus detected in step S17 and S18 from the optimum Sc value data (FIG. 6) stored in the HOD 304 (step S19).

The PC 300 then calculates the LPW value corresponding to the optimum Sc value in accordance with the relationship between the Sc values and LPW values received in step S16 (step S20). Specifically, in step S20, the relationship between the received Sc and LPW values is calculated through various interpolations. Then, on the basis of the calculated relationship between the Sc values and the LPW values, the optimum LPW value corresponding to the optimum Sc value is calculated with the inclination of the relation line between the Sc values and the LPW values taken into account.

Then, the PC 300 outputs the LPW value calculated in step S20 to the image forming apparatus 400. The image forming apparatus 400 sets the received LPW value to be the standard LPW value of the exposure device 3 for the predetermined color (step S21) to finish the present process. In step S21, the calculated LPW value may be displayed in the display section 302 of the PC 300 without being output to the image forming apparatus 400 so as to notify a user. In this case, the user manually changes the standard LPW value of the image forming apparatus 400 to the displayed LPW value displayed in the display section 302.

As described above, the image forming apparatus 400 calculates Sc values for a plurality of patch images for a toner of a predetermine color which are formed by the toner amount measuring apparatus 100 using different LPW values. The image forming apparatus 400 calculates the optimum LPW value on the basis of the calculated Sc values. Thus, compared to the conventional technique of detecting the toner amount on the basis of color information on the toner, the image forming apparatus 400 can accurately detect the toner amount not only for common toners but also for special-color and transparent toners. This enables the optimum LPW value to be set. Thus, an output image from the image forming apparatus 400 can be formed using the optimum toner amount, resulting in improved quality.

Further, the optimum Sc value is set depending on the type of recording media and the type of image forming apparatus so as to detect the optimum Sc value depending on the type of recording media and the type of image forming apparatus so that the optimum amount of recording media can be set depending on the type of recording media and the type of image forming apparatus. Therefore, the output image from the image forming apparatus 400 can be formed using the optimum toner amount.

Further, the toner amount adjusting process sets the standard LPW value of the image forming apparatus 400 at the value at which an image with the optimum toner amount is formed. Thus, even if the time degradation of component parts of the image forming apparatus 400 or the like prevents an image with the optimum toner amount from being formed using the set standard LPW value, such a standard LPW value as provides the optimum toner amount can be set. This enables the user to easily carry out calibrations. Further, setting the toner amount adjusting process so that it is automatically carried out in predetermined periods allows the inhibition of degradation of an output image caused by the time degradation of component parts or the like.

Now, description will be given of a method for measuring the amount of toner according to a second embodiment of the present invention. The method for measuring the amount of toner according to the present embodiment differs from the first embodiment in the Sc values not only of the toner part of the recording medium but also of the surroundings of the toner part are detected. Only the differences from the first embodiment will be described.

In the first embodiment, the toner amount is calculated using only the Sc value of the toner part. However, the effect of roughness of the underlying recording medium is not negligible in connection with the surface roughness of the toner fixed to the recording medium. The present embodiment presets the roughness of the base for the toner. The reason why the optimum Sc value is varied among the recording media as shown in FIG. 6 is that the recording media, serving as bases, originally have different roughnesses.

The present embodiment does not require the user to input recording medium information, thus allowing the user's working efficiency to be improved. Description will be given below of the operations of a toner amount measuring apparatus and an image forming apparatus comprising the toner amount measuring apparatus, according to the present embodiment. The same component parts as those of the first embodiment are denoted by the same reference numerals and will not be described. Only the differences from the first embodiment will be described.

Figures 11, 12:
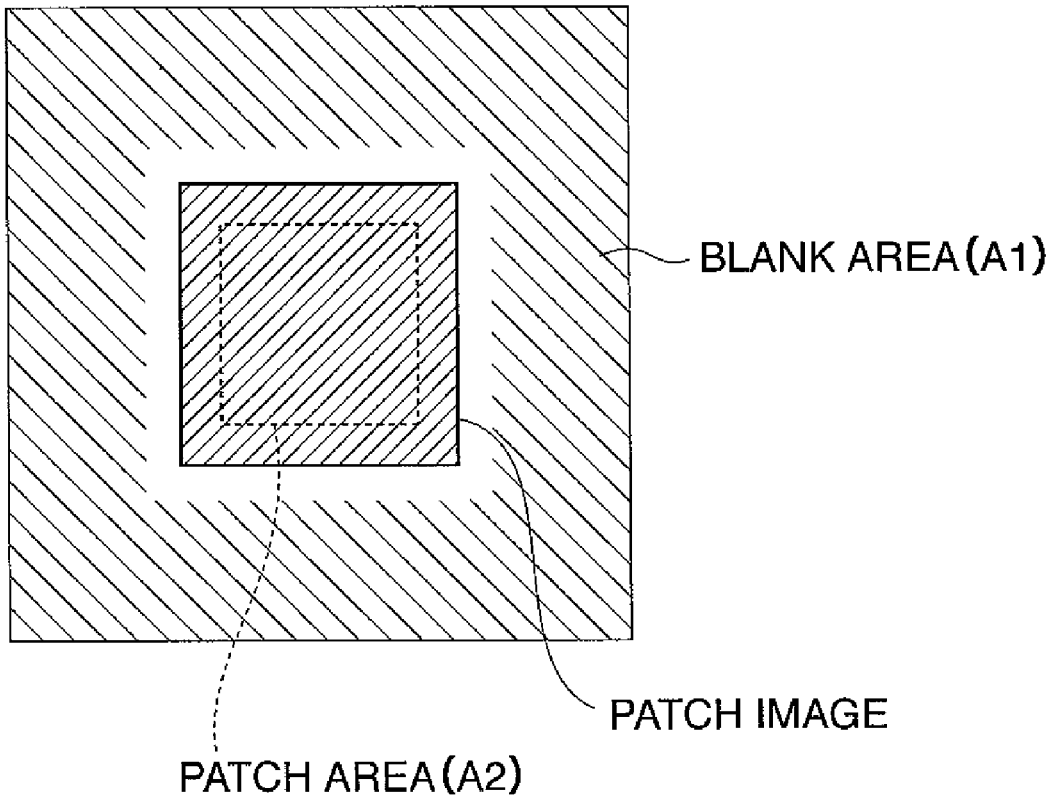
FIG. 11 is a diagram showing the areas of a toner and a recording medium to be read in a method for measuring the amount of toner according to a second embodiment of the present invention.
FIG. 12 is a diagram showing optimum Sc difference data used in a process for adjusting the amount of toner according to the second embodiment of the present invention.

Upon receiving an instruction ordering the toner amount to be detected from the user, the PC 300 allows the laser speckle sensor unit 200 to read patch images and their surroundings. In the present embodiment, the laser speckle sensor unit 200 is set so that the irradiation spot of laser light has a size covering the toner and parts of the base (recording medium) which surround the toner as shown in FIG. 11. The laser speckle sensor unit 200 then divides the read speckle pattern into two areas A1 and A2 as shown in FIG. 11. That is, the speckle pattern is divided into a blank area A1 that is an area of the base to which the toner (patch image) is not fixed and a patch area A2 to which the toner is fixed.

Then, the analyzing section 209 of the laser speckle sensor unit 200 calculates an Sc value for each of the blank area A1 and patch area A2 as described in the first embodiment. The analyzing section 209 then subtracts the Sc value (Sc(A2)) for the patch area A2 from the Sc value (Sc(A1)) for the blank area A1 to calculate an Sc difference (Sc(A1)−Sc(A2)). The analyzing section 209 then uses, instead of the optimum Sc value data in FIG. 6, preset optimum Sc difference data corresponding to the image forming apparatuses (printers A to D) shown in FIG. 12 to calculate the LPW value corresponding to the optimum Sc difference as is the case with the toner amount adjusting process shown in FIG. 10. That is, such patch images as shown in FIG. 5 are created and read into the toner amount adjusting process 100. The toner amount measuring apparatus 100 then calculates Sc values for the patch area and blank area to determine the Sc difference. Then, the relationship between the calculated Sc difference and the LPW value of the corresponding patch image is calculated. Then, the optimum Sc difference corresponding to the type of image forming apparatus 400 is retrieved from the optimum Sc difference data in FIG. 12. The LPW value corresponding to the retrieved optimum Sc difference is detected on the basis of the relationship between the calculated Sc difference and the LPW value. The detected LPW value is set to be the standard LPW value of a predetermined color for the image forming apparatus 400. The optimum Sc difference data in FIG. 12 is stored in the HDD 304 of the PC 300.

Thus, in the toner amount adjusting process, the user need not input information indicating the type of the toner. This facilitates carrying out the toner amount adjusting process. Effects similar to those of the first embodiment can also be exerted.

According to a first variation of the present embodiment, Sc(A1) can be used to detect the type of recording medium. In this case, as shown in FIG. 13, data including the optimum Sc value of a toner of a predetermined color and the Sc value (space Sc value) of each recording medium is stored in the HDD 304 for each type of image forming apparatus and each type of recording medium. The type of recording medium with an Sc value equal to or closest to the detected Sc(A1) value is selected. Then, the toner amount adjusting process shown in FIG. 10 is carried out for the optimum Sc value corresponding to the type of recording medium to calculate the LPW value corresponding to the optimum Sc value. The LPW value calculated is set to be the standard LPW value of the predetermined color. This allows the same effects as those of the above embodiment to be exerted.

A second variation of the present embodiment can be configured as follows. The above calculation of the Sc difference uses the Sc value of the blank area and does not use the Sc value of the part of the recording medium to which the toner is actually fixed. Accordingly, the blank Sc value is only a prediction. In contrast, the laser speckle sensor unit 200 reads the Sc value of each patch area before and after the formation of patch images on the recording medium. That is, the difference between the Sc value of the base itself, which is hidden under the patch image, and the Sc value of the patch image, formed on the base. The calculated Sc difference is used to carry out the above process. This enables the toner amount to be more accurately calculated. Further, in this case, the irradiation spot S has only to be large enough to cover the patch image.

Now, a third embodiment of the present invention will be described.

The present embodiment is different from the first embodiment in the manner in which the laser speckle sensor unit 200 analyzes a detected speckle pattern. The same component parts as those of the first embodiment are denoted by the same reference numerals and will not be described. Only the differences from the first embodiment will be described.

In the present embodiment, the toner amount is calculated using the light intensity distribution of the speckle pattern of two-dimensionally detected laser speckles, instead of roughness information (Sc value).

As described in the first and second embodiments, a speckle pattern on a toner formed on the recording medium varies depending on the toner amount. With a small toner amount, the speckle pattern on the recording medium is partly included in the speckle pattern on the toner. With a large toner amount, a totally different speckle pattern appears. Thus, the toner amount is calculated utilizing a variation in the speckle pattern on the toner depending on the toner amount.

The speckle pattern is two-dimensionally detected by the CCD sensor 203. The CCD sensor 203 has a sensitivity of 8 bits (256 gradations), and the speckle pattern can be expressed using three axes including a two-dimensional position (X direction and Y direction) and the light intensity of the speckle pattern (speckle intensity).

Like the second variation of the second embodiment, the present embodiment compares the speckle pattern in the patch area A2 (see FIG. 11) of the recording medium in which no patch image has been formed yet with the speckle pattern in a patch image formed on the recording medium. The LPW value is varied to form, for example, seven patch images on the recording medium (see FIG. 5).

The comparison is carried out by using Formula 3 shown below for each pixel of the CCD sensor 203 to calculate the absolute value (ΔI) of the difference in light intensity between the recording medium itself (base) and the patch image and finding the average values (AveΔI) of the absolute values ΔI for all the pixels.

$$\Delta I = |\text{Light intensity of base} - \text{light intensity of patch}| \quad \text{[Formula 3]}$$

Figure 14:
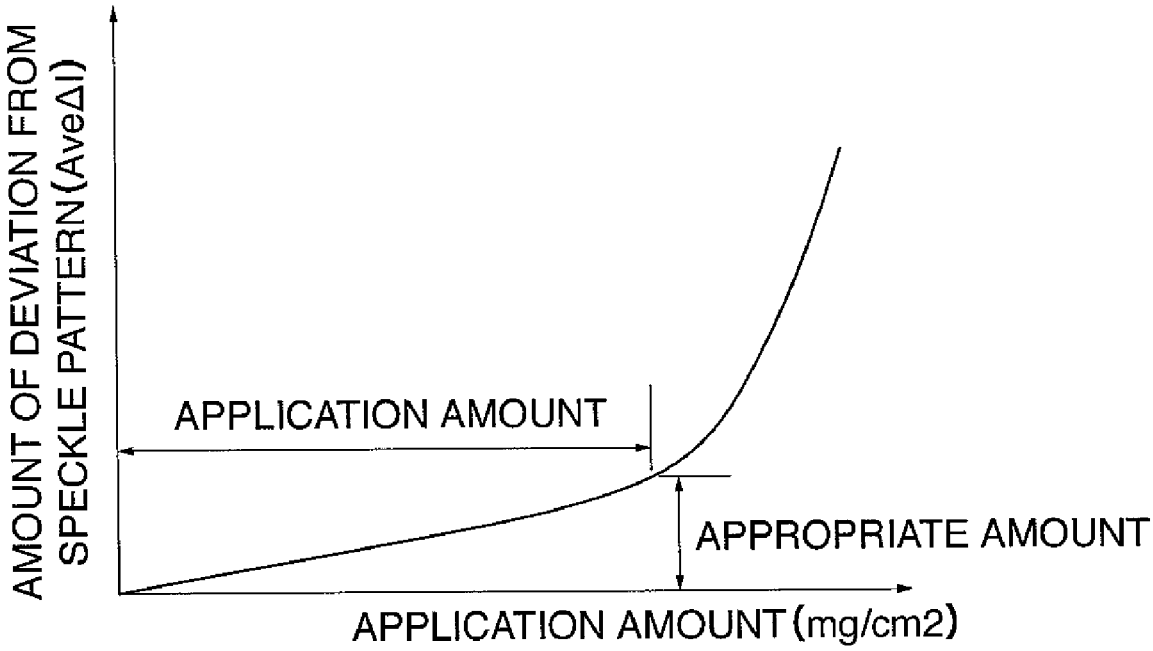
FIG. 14 is a diagram showing the relationship between the toner amount and the difference between the light intensities of a base and of a toner calculated according to a third embodiment of the present invention.

FIG. 14 shows the relationship between the calculation (AveΔI) and the toner amount. If no patch image is formed on the detection section and the pattern on the base is detected, the value of AveΔI is indefinitely close to zero. For toners such as electrophotographic toner which are stacked on or attached to the surface of the recording medium, the ΔI value increases sharply in keeping with the toner amount (toner application amount).

The present embodiment utilizes the relationship between the AveΔI and the toner amount for the toner amount adjusting process (FIG. 10) in place of the relationship between the Sc value and the LPW value to control the LPW value so as to obtain the appropriate toner amount.

The present embodiment has advantages similar to those of the first embodiment.

The present embodiment compares the speckle pattern on the base with the speckle pattern on the patch image for each pixel of the CCD sensor 203. Thus, the alignment between the detecting area (irradiation spot) on the base and the detecting area (irradiation spot) on the patch image is very important. According to the present embodiment, an alignment process described below is carried out during the analysis.

That is, both during base detecting and during patch image detecting, the speckle pattern in the blank area (A1) (see FIG. 11) is detected in addition to the speckle pattern in the patch area (A2). Then, the Sc value of the blank area (A1) detected during base detecting is compared with the Sc value of the blank area (A1) detected during patch detecting for position checking and adjustment.

The position checking during the aligning process involves extracting a speckle pattern with a characteristic speckle intensity from, for example, any of the four corners of the blank area (A1) and checking the position of the speckle pattern. The extraction may be carried out using a labeling technique, which is common in the art of image processing. In the input speckle pattern, connected pixels of the same level are provided with the same label. For example, when two white pixels of the same level are connected together, they are provided with the same label.

Figure 15:
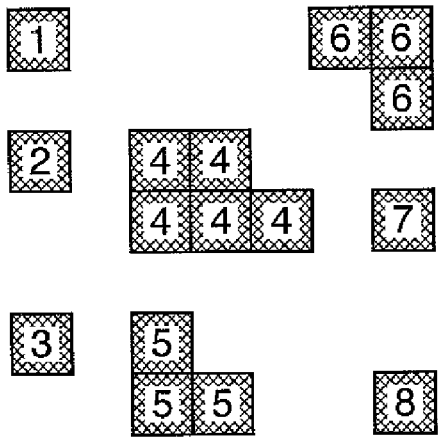
FIG. 15 is a diagram showing the concept of a labeling technique used in an alignment process carried out according to the third embodiment of the present invention.

FIG. 15 is a diagram showing the concept of the labeling technique used for the aligning process. As shown in FIG. 15, the labeling technique provides connected pixels with the same label "1" or "2". Then, the number of pixels is calculated for each provided label. A label with the most pixels is then set to be a landmark for the speckle pattern. In FIG. 15, a label "4" corresponds to a landmark label.

The landmark label appears both in the blank area (A1) detected during base detecting and in the blank area (A1) detected during patch detecting. Thus, alignment is carried out by using the characteristic pattern shown by the pixels for the landmark label as a landmark to detect the misalignment between the speckle pattern on the base and the speckle pattern on the patch image. For the alignment, enlarging/reducing processing or a correcting process is carried out; an enlarging/reducing process is appropriately carried out using, for example, the well-known nearest neighbor interpolation.

The present embodiment also requires the optimum Sc value for each type of image forming apparatus (see FIG. 6). Thus, the PC 300 gets type information on the image forming apparatus 400 and uses the change amount (AveΔI) of the speckle pattern to determine the optimum LPW value corresponding to the optimum Sc value of this type.

Now, a first variation of the present embodiment will be described.

The third embodiment, as described above, processes the speckle pattern of laser speckles imaged by the CCD sensor 203, on the basis of 8 bits. In view of a variation in the quantity of laser light, the sensitivity characteristic of the sensor, and the like, noise in the 8 bits may cause an error in the comparison. Thus, to avoid this problem, the present variation carries out a binarizing process on the speckle pattern detected by the CCD sensor 203. The binarizing process may involve setting 50% parts of the maximum and minimum luminances to be thresholds, or automatic binarization, or setting 60% parts, used for line image evaluation in accordance with the ISO13660, to be thresholds. Then, for the intensity distribution image subjected to the binarizing process, the difference in light intensity between the base and the patch image is calculated to determine and adjust the toner amount.

Now, a second variation of the present embodiment will be described.

The first or second embodiment uses information indicative of the surface roughness (Sc value) to calculate the toner amount of the toner. When the toner amount is calculated only from the Sc value, it is necessary to, for example, take into account the inclination of the relation line between the toner amount and the Sc value or to form many patch images to determine the inflection point of the relation line.

Figure 16:
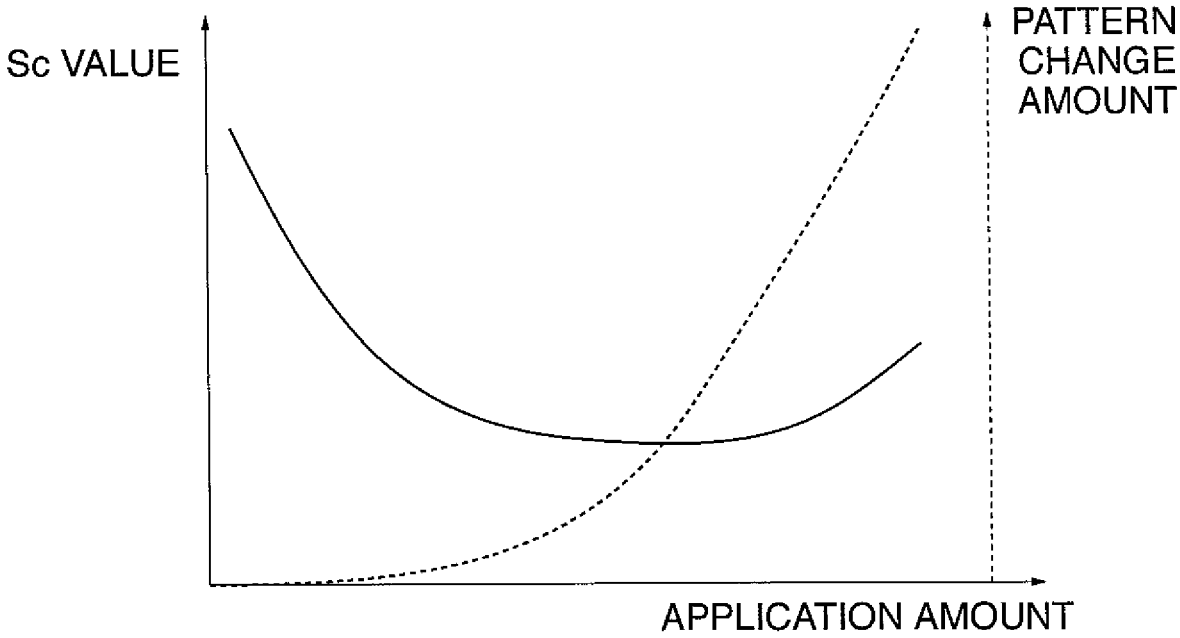
FIG. 16 is a diagram showing the relationship between toner amount and the Sc value and the relationship between the toner amount and the difference between the light intensities of a base and of a toner.

The present variation uses both the Sc value and the pattern change amount (ΔI) to reduce the number of patch images formed or the time spent for measurement for speckle patterns. The present variation is particularly effective on an image forming apparatus characterized in that the toner amount varies significantly relative to the Sc value as shown in FIG. 16.

Now, a third variation of the present embodiment will be described.

With an enlarged patch area, the laser speckle sensor unit 200 requires a lens of a large diameter or a plurality of lens groups to increase the size of the irradiation spot. Accordingly, the laser speckle sensor unit 200 may be able to vary the size of the irradiation spot. The laser speckle sensor unit 200 has only to be a light emitting apparatus that generates coherent light. For example, the laser speckle sensor unit 200 may be a laser display device to which a MEMS (Micro Electro Mechanical System) technique described in Japanese Laid-Open Patent Publication (Kokai) No. 2003-241122 is applied. However, the present invention detects laser speckles and thus may avoid the use of a diffuser.

Now, a fourth embodiment of the present invention will be described.

Figure 17:
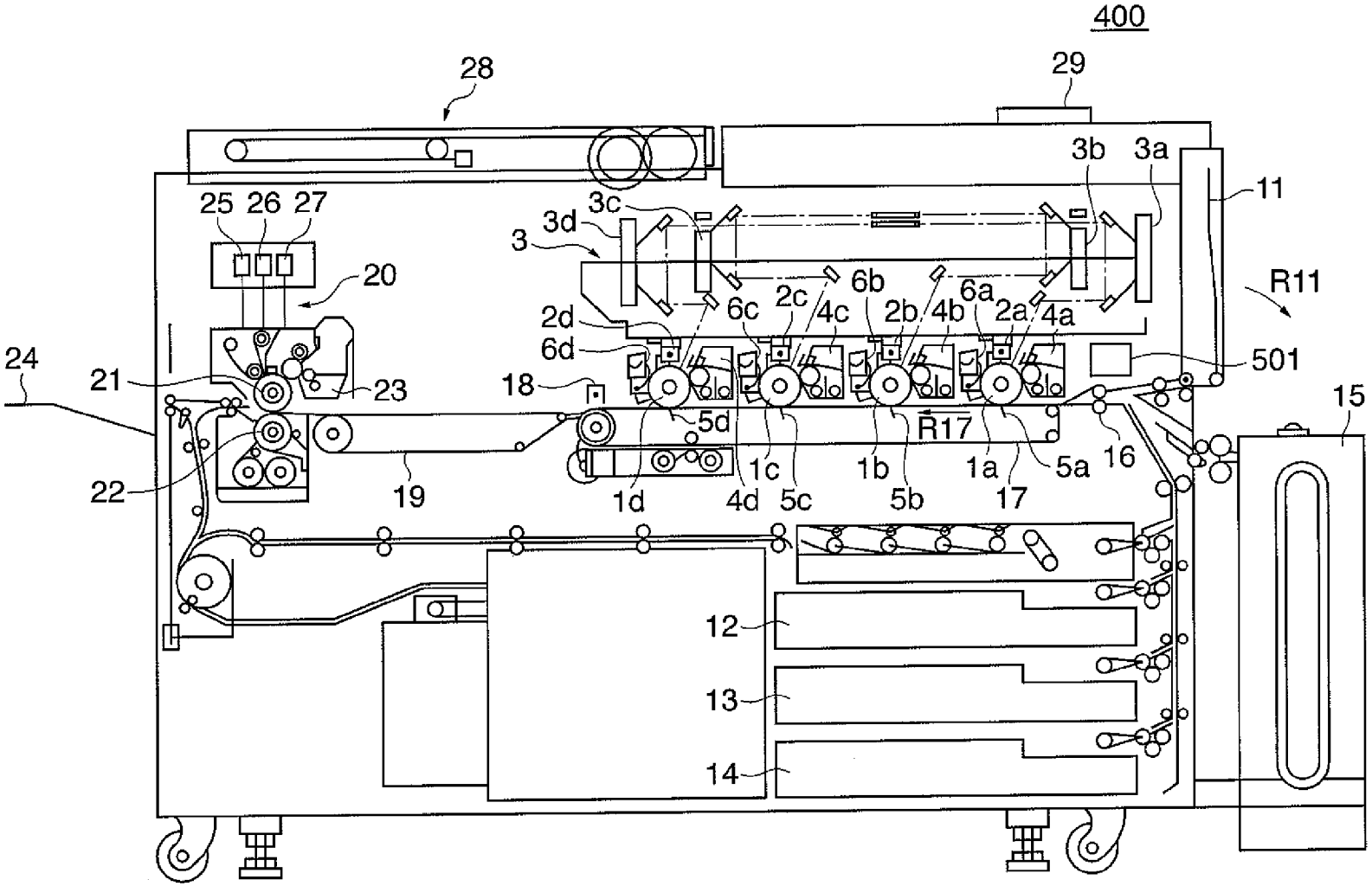
FIG. 17 is a sectional view schematically showing the construction of an image forming apparatus according to a fourth embodiment of the present invention.
Figure 18:
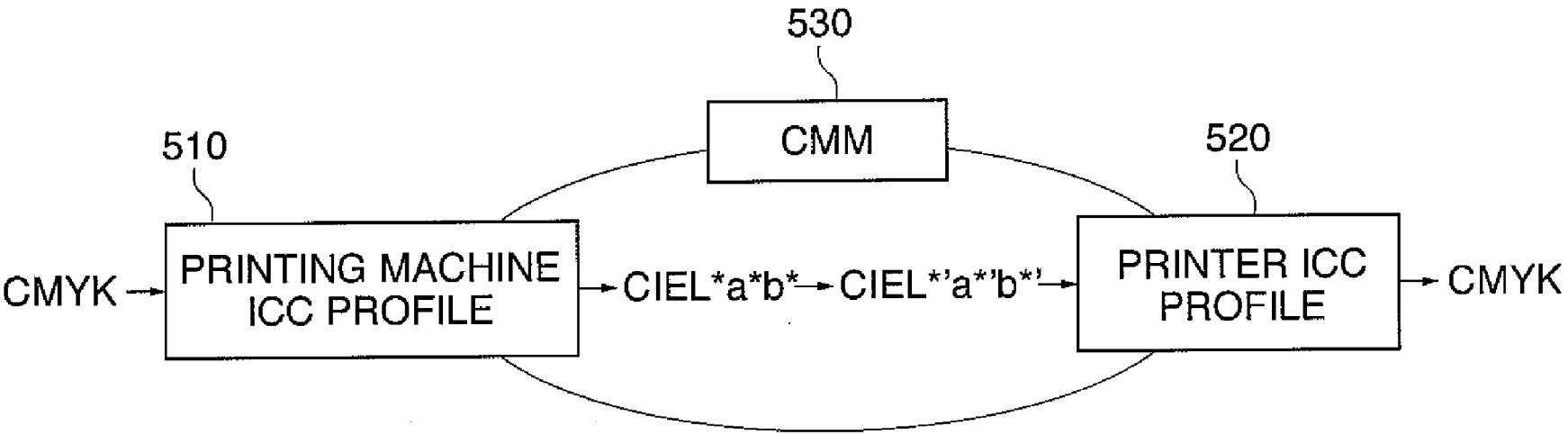
FIG. 18 is a diagram generally showing a conventional method for color management.
Figure 19:
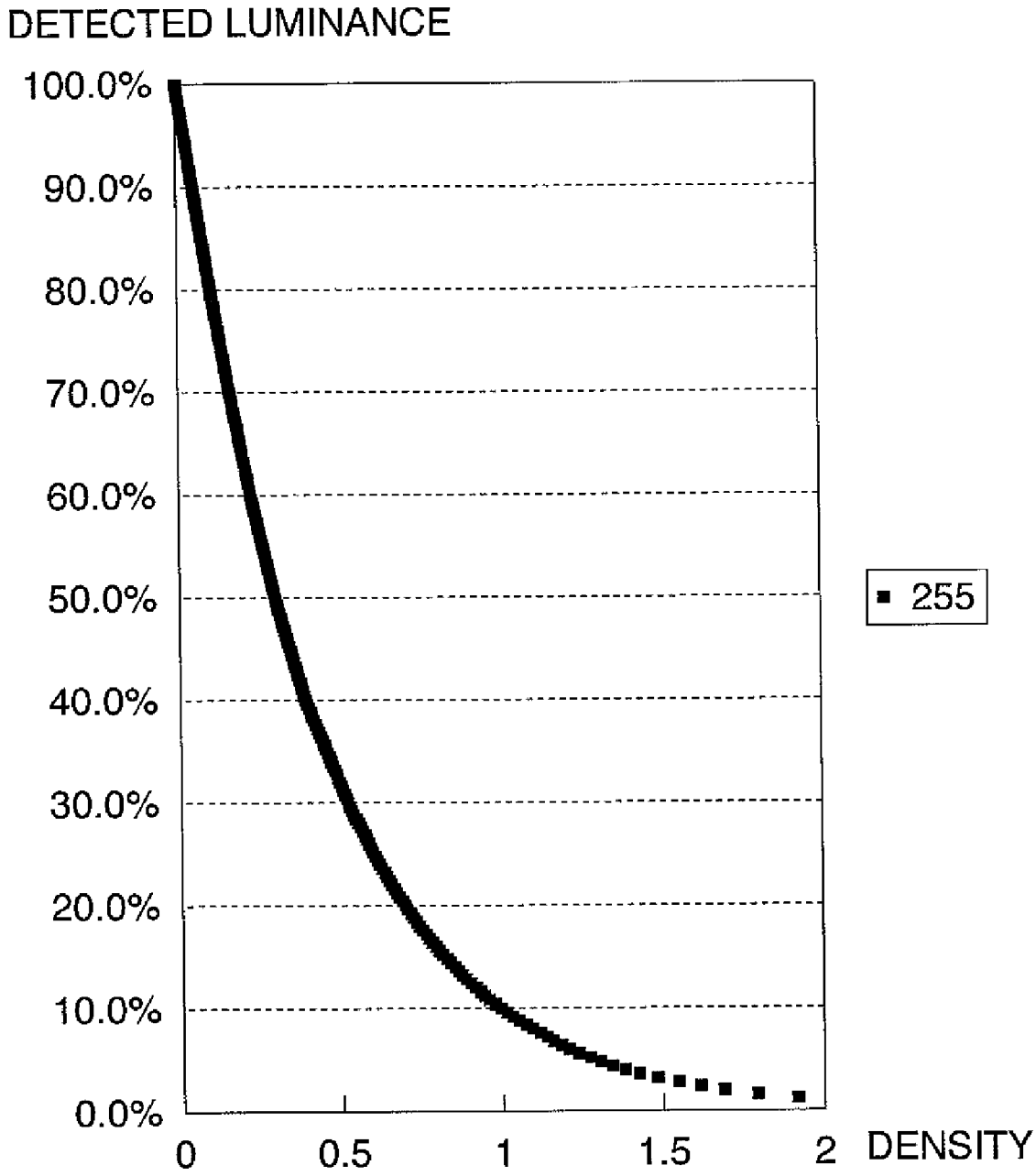
FIG. 19 is a diagram showing the relationship between the density of a toner and detected luminance.
Figure 20:
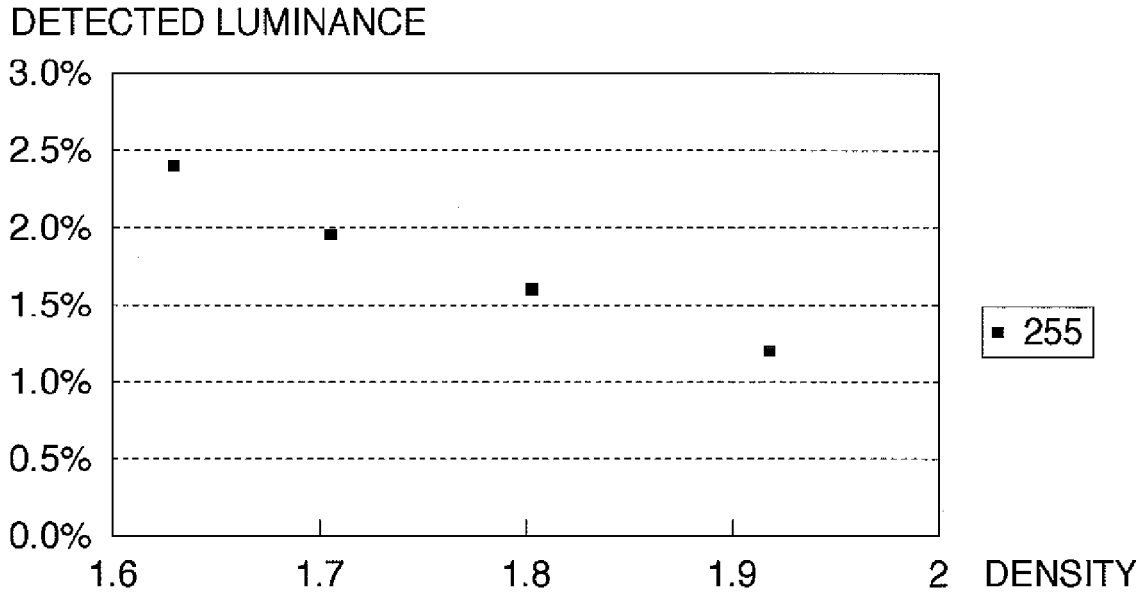
FIG. 20 is a diagram showing the relationship between the density of a toner and the detected luminance with a high density part.
Figure 21:
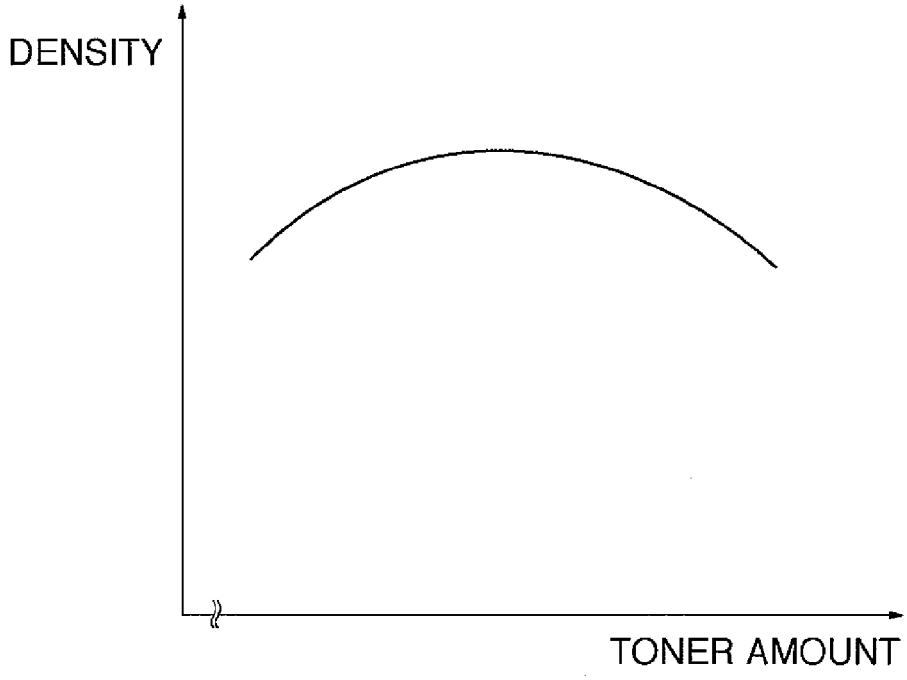
FIG. 21 is a diagram showing the relationship between the amount and density of a toner.

In the present embodiment, the toner amount measuring apparatus in any of the above embodiments is mounted in the image forming apparatus 400 as shown in FIG. 17.

In the present embodiment, as shown in FIG. 17, a detecting device 501 comprising the optical system unit (LD 201, LD driver circuit 202, CCD sensor 203, CCD driver circuit 204, and lens 205) of the toner amount measuring apparatus 100 is located near the registration roller 16. Further, the calculation unit 206 and the component parts of the PC 300 is incorporated into an image processing device (not shown) provided in the image forming apparatus 400.

The image forming apparatus 400 according to the present embodiment forms a predetermined number of patch images in an area (hereinafter referred to as a registration stop area) of the recording medium which is located opposite the detecting device 501 at a registration stop position. Alternatively, the image forming apparatus 400 detects the surface (registration stop area) of the recording medium at the registration stop position before forming patch images thereon and then forms the patch images in the registration stop area. The recording medium usually passes through a double-side conveying section via a reversal section, but for the detecting, passes through a reversal path without being reversed and is conveyed to a registration position again. The detecting device 101 then reads the patch images on the recording medium stopped at the registration stop position. Subsequently, the toner amount is calculated and adjusted as is the case with the above embodiments.

Compared to the above embodiments, the present embodiment does not require type information on the image forming apparatus and the like to be input to the PC 300. This allows the user to carry out calibrations simply by depressing an execution button.

Now, a fifth embodiment of the present invention will be described.

As described above, such conventional techniques as described in Japanese Laid-Open Patent Publication (Kokai) Nos. H11-075067, 2002-072574, and 2003-215981 cannot accurately detect the maximum density part. Thus, the toner amount measuring apparatus using laser diffusion light according to the present invention may be used only to detect the maximum density of the toner.

In the present embodiment, a density detecting sensor that outputs wideband light having a wider band than laser light is provided in the image forming apparatus to automatically detect the density of the toner. Then, under certain maximum density conditions, the final fine tuning is carried out using laser diffusion light. Alternatively, it is possible to use laser diffusion light to adjust the maximum density, while using a normal sensor to adjust the other gradations. Moreover, the laser diffusion light and the normal sensor may be selected in accordance with costs or productivity.

As described above, the present invention can accurately measure the toner amount even though the measured part of the recording medium has a high density, the toner is transparent, or the toner is in a special color. Further, the toner amount of the image forming apparatus can be appropriately controlled to the optimum value.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2006-111047 filed Apr. 13, 2006, which is hereby incorporated by reference herein in its entirety.

What is claimed is:

1. A method for measuring the amount of toner on a recording medium, the method comprising:

a recording medium information acquiring step of acquiring information on said recording medium to which said toner is fixed;

a light irradiating step of irradiating said toner fixed to said recording medium with laser light;

a light intensity distribution detecting step of detecting a light intensity distribution of reflected light of said laser light with which said toner is irradiated; and a toner amount calculating step of calculating the amount of said toner on said recording medium on the basis of said acquired recording medium information and said detected light intensity distribution.

2. The method for measuring the amount of toner according to claim 1, further comprising a toner amount control step of controlling the amount of said toner to be fixed to said recording medium in order to form an image on said recording medium, on the basis of said calculated toner amount.

3. The method for measuring the amount of toner according to claim 1, wherein said toner amount calculating step converts said detected light intensity distribution into surface roughness information indicative of surface roughness of said toner to compare the resulting surface roughness information with said recording medium information, and calculates the amount of said toner on said recording medium on the basis of the comparison result.

4. The method for measuring the amount of toner according to claim 1, further comprising a fixation target amount calculating step of calculating the target amount of said toner to be fixed to said recording medium on the basis of said recording medium information.

5. A method for measuring the amount of toner on a recording medium, the method comprising:

a light irradiating step of irradiating said recording medium and said toner fixed to said recording medium with laser light;

a light intensity distribution detecting step of detecting a light intensity distribution of reflected light of said laser light with which said recording medium and said toner are irradiated;

a light intensity distribution comparing step of comparing a light intensity distribution of reflected light from said recording medium with a light intensity distribution of reflected light from said toner, both light intensity distributions being included in said detected light intensity distribution; and a toner amount calculating step of calculating the amount of said toner on the basis of the comparison result of said light intensity distribution comparing step.

6. The method for measuring the amount of toner according to claim 5, wherein said light intensity distribution comparing step calculates a difference between the light intensity distribution of reflected light from said recording medium and the light intensity distribution of reflected light from said toner, and said toner amount calculating step calculates said toner amount on the basis of said calculated difference.

7. The method for measuring the amount of toner according to claim 5, wherein said light intensity distribution comparing step converts said detected light intensity distribution into surface roughness information indicative of surface roughnesses of said recording medium and said toner, and said toner amount calculating step calculates said toner amount on the basis of said resulting surface roughness information.

8. The method for measuring the amount of toner according to claim 7, wherein said toner amount calculating step calculates said toner amount on the basis of said calculated difference and said resulting surface roughness information.

9. The method for measuring the amount of toner according to claim 5, wherein said light irradiating step comprises a recording medium light irradiating step of irradiating said recording medium to which said toner has not been fixed yet, with said laser light and a toner irradiating step of irradiating said toner fixed to said recording medium, with said laser light, and said light intensity comparing step comprises an aligning step of comparing the light intensity distribution of reflected light from said recording medium to which said toner has not been fixed yet, with the light intensity distribution of reflected light from said toner fixed to said recording medium to align a detection area for the light intensity distribution of reflected light from said recording medium with a detection area for the light intensity distribution of reflected light from said toner, said laser light covering an area wider than said toner.

10. The method for measuring the amount of toner according to claim 5, wherein said toner is transparent or colored and changes surface characteristics of said recording medium.

11. A method for image formation comprising the method for measuring the amount of toner according to claim 5, the method for image formation comprising:

a toner amount control step of controlling the amount of said toner to be fixed to said recording medium in order to form an image on said recording medium, on the basis of said calculated toner amount.

12. The method for image formation according to claim 11, further comprising:

a wideband light irradiating step of irradiating said recording medium and said toner fixed to said recording medium with wideband light having a wider band than said laser light; and a wideband light reflected light detecting step of detecting reflected light of said wideband light with which said toner is irradiated, and wherein said toner amount control step controls the amount of said toner to be fixed to said recording medium on the basis of said detected reflected light of said wideband light and the calculation result of said toner amount calculating step.

13. The method for image formation according to claim 12, wherein said toner amount control step controls a maximum application amount included in said toner amount on the basis of the calculation result of said toner amount calculating step, while controlling said toner amount other than said maximum application amount on the basis of said detected wideband light reflected light.

14. A toner amount measuring apparatus configured to measure the amount of toner on a recording medium, the apparatus comprising:

a recording medium information storing unit configured to store information on said recording medium to which said toner is fixed;

a light irradiating unit configured to irradiate said toner fixed to said recording medium with laser light;

a light intensity distribution detecting unit configured to detect a light intensity distribution of reflected light of said laser light with which said toner is irradiated; and a toner amount calculating unit configured to calculate the amount of said toner on said recording medium on the basis of said stored recording medium information and said detected light intensity distribution.

15. The toner amount measuring apparatus according to claim 14, further comprising a toner amount control unit configured to control the amount of said toner to be fixed to said recording medium in order to form an image on said recording medium, on the basis of said calculated toner amount.

16. The toner amount measuring apparatus according to claim 14, wherein said toner amount calculating unit converts said detected light intensity distribution into surface roughness information indicative of surface roughness of said toner to compare the resulting surface roughness information with said recording medium information, and calculates the amount of said toner on said recording medium on the basis of the comparison result.

17. The toner amount measuring apparatus according to claim 14, further comprising a fixation target amount calculating unit configured to calculate the target amount of said toner to be fixed to said recording medium on the basis of said recording medium information.

18. A toner amount measuring apparatus configured to measure the amount of toner on a recording medium, the apparatus comprising:

a light irradiating unit configured to irradiate said recording medium and said toner fixed to said recording medium with laser light;

a light intensity distribution detecting unit configured to detect a light intensity distribution of reflected light of said laser light with which said recording medium and said toner are irradiated;

a light intensity distribution comparing unit configured to compare a light intensity distribution of reflected light from said recording medium with a light intensity distribution of reflected light from said toner, both light intensity distributions being included in said detected light intensity distribution; and a toner amount calculating unit configured to calculate the amount of said toner on the basis of the comparison result provided by said light intensity distribution comparing unit.

19. The toner amount measuring apparatus according to claim 18, wherein said light intensity distribution comparing unit calculates a difference between the light intensity distribution of reflected light from said recording medium and the light intensity distribution of reflected light from said toner, and said toner amount calculating unit calculates said toner amount on the basis of said calculated difference.

20. The toner amount measuring apparatus according to claim 18, wherein said light intensity distribution comparing unit converts said detected light intensity distribution into surface roughness information indicative of surface roughnesses of said recording medium and said toner, and said toner amount calculating unit calculates said toner amount on the basis of said resulting surface roughness information.

21. The toner amount measuring apparatus according to claim 20, wherein said toner amount calculating unit calculates said toner amount on the basis of said calculated difference and said resulting surface roughness information.

22. The toner amount measuring method according to claim 18, wherein said light irradiating unit comprises a recording medium light irradiating unit configured to irradiate said recording medium to which said toner has not been fixed yet, with said laser light and a toner irradiating unit configured to irradiate said toner fixed to said recording medium, with said laser light, and said light intensity distribution comparing unit further comprises an aligning unit configured to compare the light intensity distribution of reflected light from said recording medium to which said toner has not been fixed yet, with the light intensity distribution of reflected light from said toner fixed to said recording medium to align a detection area for the light intensity distribution of reflected light from said recording medium with a detection area for the light intensity distribution of reflected light from said toner, and wherein said laser light covers an area wider than said toner.

23. The toner amount measuring apparatus according to claim 18, wherein said toner is transparent or colored and changes surface characteristics of said recording medium.

24. An image forming apparatus comprising the toner amount measuring apparatus according to claim 18, the image forming apparatus comprising:

a toner amount control unit configured to control the amount of said toner to be fixed to said recording medium in order to form an image on said recording medium, on the basis of said calculated toner amount.

25. The image forming apparatus according to claim 24, further comprising:

a wideband light irradiating unit configured to irradiate said recording medium and said toner fixed to said recording medium with wideband light having a wider band than said laser light; and a wideband light reflected light detecting unit configured to detect reflected light of said wideband light with which said toner is irradiated, and wherein said toner amount control unit controls the amount of said toner to be fixed to said recording medium on the basis of said detected reflected light of said wideband light and the calculation result provided by said toner amount calculating unit.

26. The image forming apparatus according to claim 25, wherein said toner amount control unit controls a maximum application amount included in said toner amount on the basis of the calculation result provided by said toner amount calculating unit, while controlling said toner amount other than said maximum application amount on the basis of said detected wideband light reflected light.

* * * * *